US010452003B2

(12) United States Patent
Terada

(10) Patent No.: US 10,452,003 B2
(45) Date of Patent: Oct. 22, 2019

(54) DEVELOPING APPARATUS

(71) Applicant: CANON KABUSHIKI KAISHA, Tokyo (JP)

(72) Inventor: Ryohei Terada, Matsudo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/216,276

(22) Filed: Dec. 11, 2018

(65) Prior Publication Data

US 2019/0187590 A1 Jun. 20, 2019

(30) Foreign Application Priority Data

Dec. 18, 2017 (JP) ..... 2017-242138

(51) Int. Cl.
*G03G 15/09* (2006.01)

(52) U.S. Cl.
CPC ..... *G03G 15/0921* (2013.01)

(58) Field of Classification Search
CPC ..... G03G 15/0921; G03G 15/0898; G03G 15/0896
See application file for complete search history.

(56) References Cited

U.S. PATENT DOCUMENTS 7,333,746 B2 2/2008 Nagata et al.
9,268,263 B2 2/2016 Ariizumi et al.
2015/0093139 A1* 4/2015 Kuramoto ..... G03G 15/0806 399/92
2016/0070205 A1* 3/2016 Murata ..... G03G 15/0887 399/254
2018/0107143 A1 4/2018 Shigehiro et al.
2018/0284641 A1 10/2018 Soeta et al.
2018/0284643 A1 10/2018 Takahashi et al.
2018/0284656 A1 10/2018 Takahashi et al.

FOREIGN PATENT DOCUMENTS

JP 2006-113408 A 4/2006
JP 2006-145815 A 6/2006

* cited by examiner

*Primary Examiner* — Sandra Brase
(74) *Attorney, Agent, or Firm* — Venable LLP

(57) ABSTRACT

A developing apparatus includes a developing container, a rotatable developer bearing member, a magnet, and a wall portion. The magnet is provided in the developer bearing member and has a first magnetic pole and a second magnetic pole of the same polarity as the first magnetic pole. The second magnetic pole is adjacent to and downstream of the first magnetic pole in a rotation direction of the developer bearing member. The wall portion is disposed to face the developer bearing member in an area downstream of the first magnetic pole and upstream of the second magnetic pole in the rotation direction and is configured such that gaps between the wall portion and respective end portions of a developer bearing area in a rotation axis direction of the developer bearing member are smaller than a gap between the wall portion and a center portion of the developer bearing area.

9 Claims, 15 Drawing Sheets

DEVELOPING APPARATUS

BACKGROUND OF THE INVENTION

Field of the Invention

The present invention relates to a developing apparatus configured to use two-component developer containing non-magnetic toner and magnetic carrier.

Description of the Related Art

An image forming apparatus using an electro-photographic system or an electrostatic recording system includes a developing apparatus configured to develop an electrostatic latent image formed on a photosensitive drum serving as an image bearing member by developer. The developing apparatus includes a developing sleeve serving as a developer bearing member that rotates while bearing the developer to supply the developer borne on the developing sleeve to the photosensitive drum.

In a case of such developing apparatus, there is a possibility that air flows into a developing container composing the developing apparatus by rotation of the developing sleeve, air pressure within the developing container increases and the developer within the developing container scatters out of the developing container. Due to that, Japanese Patent Application Laid-open No. 2006-113408 proposes a configuration in which a gap between a part of an opening portion of the developing container located downstream in terms of a rotation direction of the developing sleeve and the developing sleeve is reduced at both longitudinal ends of the developing sleeve more than that at a center portion.

However, because toner peeled off the developing sleeve tends to float in an area downstream of the peeling magnetic pole in the rotation direction of the developing sleeve, the toner is in a condition of liable to head toward the opening portion. Due to that, if the developing sleeve is rotated fast along with acceleration of speed of a recent image forming apparatus, an amount of the floating toner is liable to increase, and a new countermeasure is required.

SUMMARY OF THE INVENTION

The present invention provides a developing apparatus capable of suppressing developer from scattering by reducing the amount of toner heading to the opening portion.

According to one aspect of the present invention, a developing apparatus includes a developing container storing two-component developer containing nonmagnetic toner and magnetic carrier, a rotatable developer bearing member configured to bear the developer, a magnet provided in the developer bearing member and having a first magnetic pole and a second magnetic pole of the same polarity as the first magnetic pole, the second magnetic pole being adjacent to and downstream of the first magnetic pole in a rotation direction of the developer bearing member, and a wall portion disposed to face the developer bearing member in an area on a downstream side of the first magnetic pole and on an upstream side of the second magnetic pole in the rotation direction of the developer bearing member and configured such that gaps between the wall portion and respective end portions of a developer bearing area which bears the developer on the developer bearing member in a rotation axis direction of the developer bearing member are smaller than a gap between the wall portion and a center portion of the developer bearing area.

Further features of the present invention will become apparent from the following description of exemplary embodiments with reference to the attached drawings.

DESCRIPTION OF THE EMBODIMENTS

First Embodiment

A first embodiment will be described below with reference to FIGS. 1 through 12. At first, a configuration of an image forming apparatus of the present embodiment will be briefly described below with reference to FIGS. 1 and 2.

Image Forming Apparatus

The image forming apparatus 100 of the present embodiment is an electro-photographic tandem full-color printer including four image forming portions PY, PM, PC and PK respectively having a photosensitive drum 1 serving as an image bearing member. The image forming apparatus 100 is configured to form a toner image or an image on a recording material in accordance with an image signal from a document reading apparatus not illustrated connected with an apparatus body 100A or from a host device such as a personal computer communicably connected with the apparatus body 100A. Examples of the recording material include a sheet material such as a sheet of paper, a plastic film, and a cloth. The image forming portions PY, PM, PC and PK form toner images of yellow, magenta, cyan and black, respectively.

It is noted that the four image forming portions PY, PM, PC and PK provided in the image forming apparatus 100 have substantially the same configuration except of their developed colors. Accordingly, only the image forming portion PY will be typically described below and a description of other image forming portions will be omitted.

Figure 2:
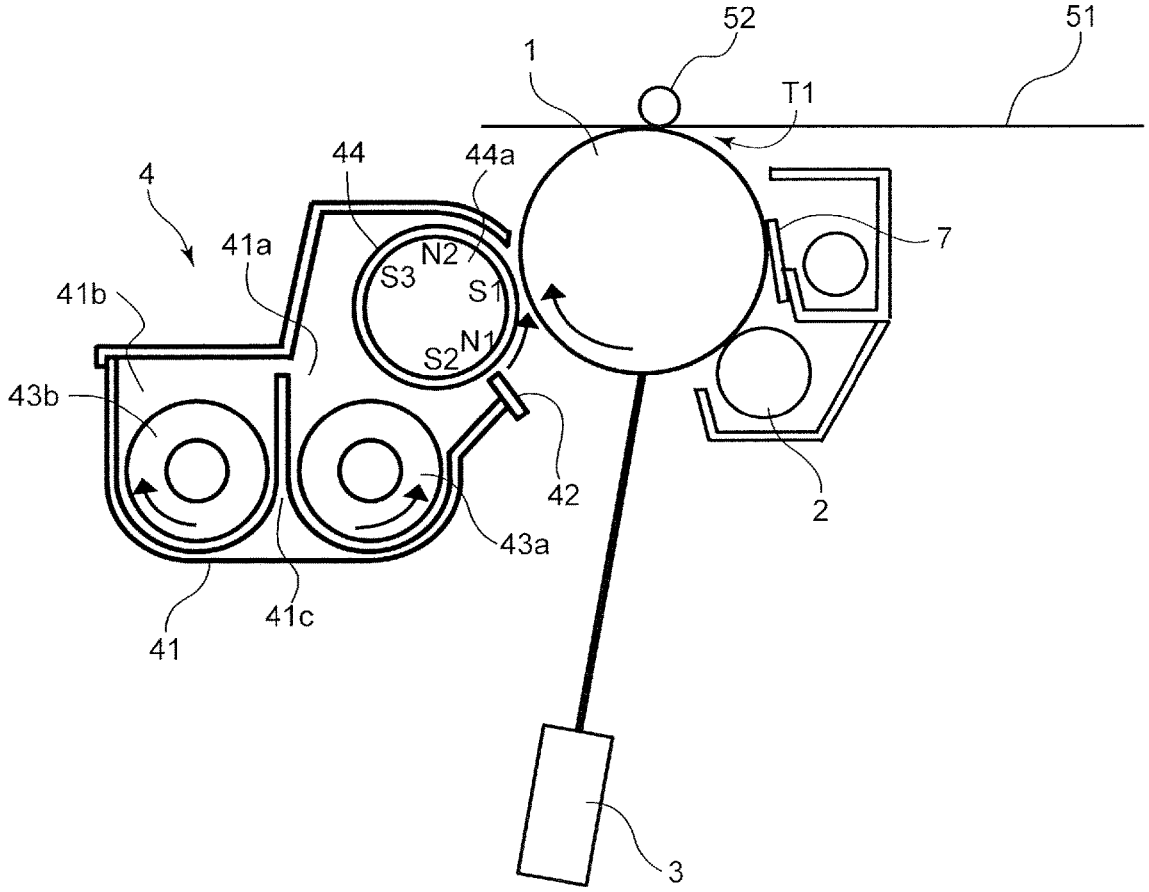
FIG. 2 is a schematic section view illustrating a configuration of an image forming portion of the first embodiment.

As illustrated in FIG. 2, the image forming portion PY is provided with a cylindrical photosensitive member, i.e., a photosensitive drum 1 serving as an image bearing member. The photosensitive drum 1 is rotationally driven in a direction of an arrow in FIG. 2. Disposed around the photosensitive drum 1 are a charging roller 2 serving as a charging unit, a developing apparatus 4, a primary transfer roller 52 serving as a transfer unit and a cleaning unit 7. Disposed under the photosensitive drum 1 in FIG. 2 is an exposing unit (a laser scanner in the present embodiment) 3.

Figure 1:
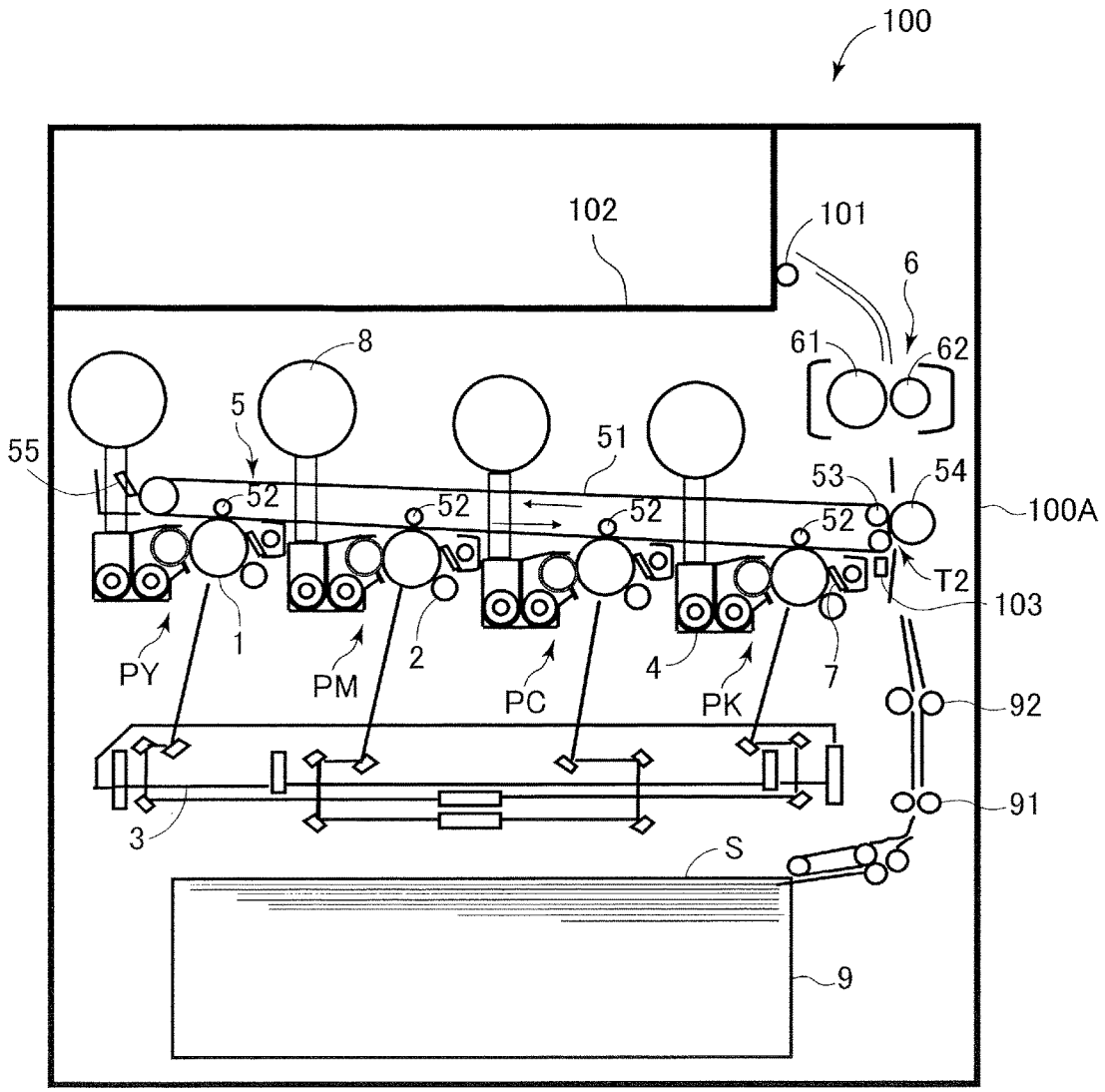
FIG. 1 is a schematic section view illustrating a configuration of an image forming apparatus of a first embodiment.

Disposed above each image forming portion in FIG. 1 is a transfer unit 5. The transfer unit 5 includes an endless intermediate transfer belt 51 serving as an intermediate transfer member by being stretched between a plurality of rollers and configured to circularly move, i.e., to rotate, in a direction of an arrow. Then, the intermediate transfer belt 51 bears and conveys a toner image primarily transferred onto the intermediate transfer belt 51 as described later. A secondary transfer outer roller 54 serving as a secondary transfer unit is disposed at a position facing a secondary transfer inner roller 53 among rollers stretching the intermediate transfer belt 51 while interposing the intermediate transfer belt 51 and composes a secondary transfer portion T2 configured to transfer the toner image on the intermediate transfer belt 51 onto a recording material. A fixing unit 6 is disposed downstream in a recording material conveyance direction of the secondary transfer portion T2.

A cassette 9 in which the recording material S is stored is disposed at a lower part of the image forming apparatus 100. The recording material S fed from the cassette 9 is conveyed toward a registration roller 92 by a conveyance roller 91. The registration roller 92 in a halt condition corrects a skew of the recording material S by causing the recording material S to form a loop when a leading edge of the recording material S abuts with the registration roller 92. After that, the registration roller 92 starts to rotate in synchronism with the toner image on the intermediate transfer belt 51 to convey the recording material S to the secondary transfer portion T2.

A process of forming a four color full-color image for example by the image forming apparatus 100 constructed as described above will now be described. When an image forming operation starts, a surface of the rotating photosensitive drum 1 is uniformly charged by the charging roller 2. Next, the photosensitive drum 1 is exposed with a laser beam, corresponding to image signals, emitted from the exposure unit 3. Thereby, an electrostatic latent image corresponding to the image signal is formed on the photosensitive drum 1. The electrostatic latent image on the photosensitive drum 1 is developed and visualized by toner stored as developer within the developing apparatus 4.

The toner image formed on the photosensitive drum 1 is primarily transferred onto the intermediate transfer belt 51 at the primary transfer portion T1 (see FIG. 2) composed of the photosensitive drum 1 and the primary transfer roller 52 disposed so as to face the photosensitive drum 1 while interposing the intermediate transfer belt 51 therebetween. At this time, a primary transfer bias is applied to the primary transfer roller 52. The toner remained on the surface of the photosensitive drum 1 after the transfer, i.e., transfer residual toner, is removed by a cleaning unit 7.

This sort of operation is performed sequentially in each of the image forming portions of yellow, magenta, cyan and black, and four color toner images are superimposed on the intermediate transfer belt 51. After that, the recording material S stored in the cassette 9 is conveyed to the secondary transfer portion T2 in synchronism with toner image forming timing. Then, the four color toner image on the intermediate transfer belt 51 is secondarily transferred collectively onto the recording material S by applying a secondary transfer bias to a secondary transfer outer roller 54. The toner remained on the intermediate transfer belt 51 without being transferred in the secondary transfer portion T2 is removed by an intermediate transfer belt cleaner 55.

Next, the recording material S is conveyed to the fixing unit 6. The fixing unit 6 includes a fixing roller 61 having a heat source such as a halogen heater therein and a pressure roller 62. The fixing roller 61 and the pressure roller 62 form a fixing nip portion. The recording material S onto which the toner image has been transferred is passed through the fixing nip portion of the fixing unit 6 to heat and to pressurize the recording material S. The toners on the recording material S melt and are mixed and fixed as a full-color image on the recording material S. After that, the recording material S is discharged by a discharge roller 101 to a discharge tray 102. Thereby, the series of the image forming process is finished.

Note that the image forming apparatus 100 of the present embodiment can form a monochrome image by using the image forming portion of a desired monochrome image such as a black monochrome image or a multi-color image by using the image forming portions of several colors of four colors.

Developing Apparatus

Next, a detailed configuration of the developing apparatus 4 will be described with reference to FIGS. 3 and 4. The developing apparatus 4 includes a developing container 41 configured to store developer containing nonmagnetic toner and magnetic carrier and a developing sleeve 44 serving as a developer bearing member that rotates while bearing the developer within the developing container 41. Disposed within the developing container 41 are conveyance screws 43*a* and 43*b* serving as developer conveyance members that circulate the developer within the developing container 41 while agitating and conveying the developer. Disposed non-rotationally within the developing sleeve 44 is a magnet roller 44*a* serving as a magnet having a plurality of magnet poles arrayed in a rotation direction. The developing apparatus 4 also includes a developing blade 42 serving as a regulation member configured to form a thin layer of the developer on a surface of the developing sleeve 44.

Figure 3:
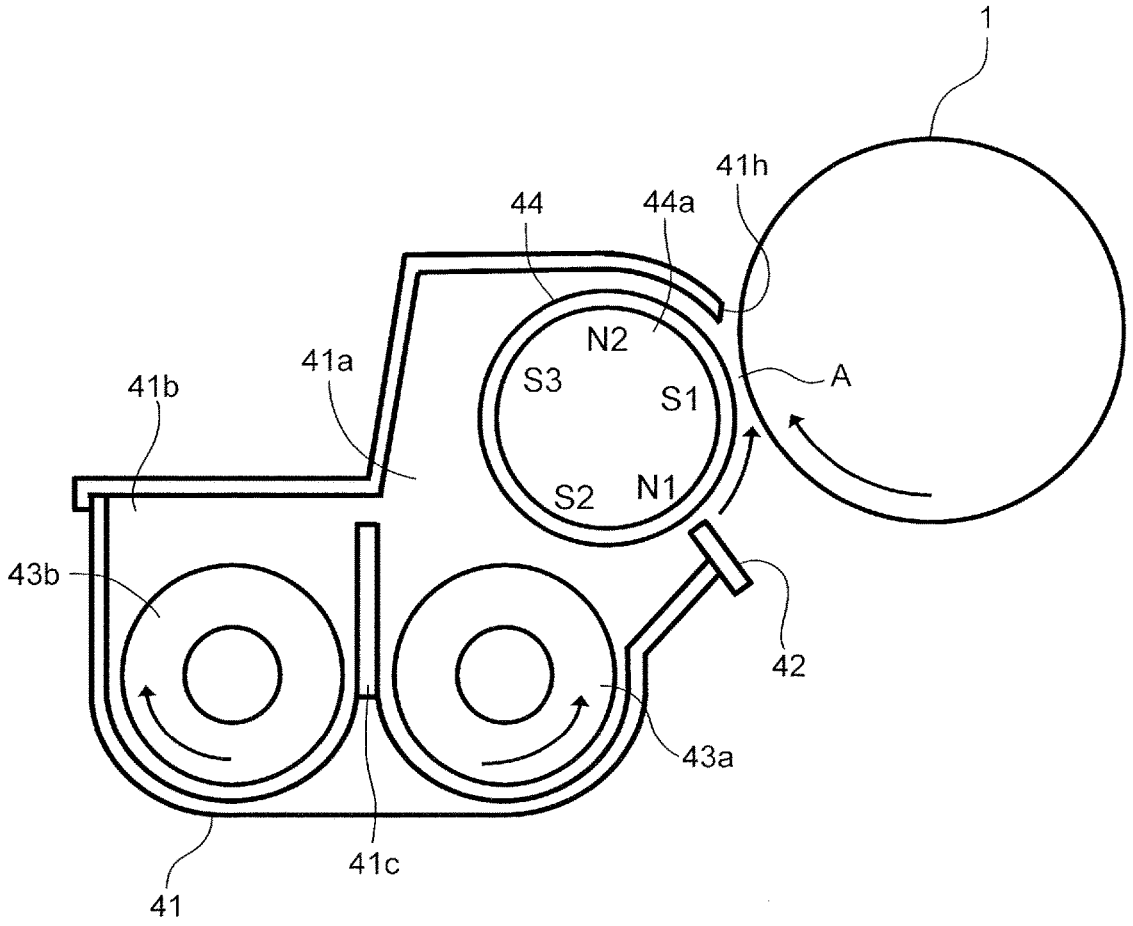
FIG. 3 is a schematic transverse section view illustrating a configuration of a developing apparatus of the first embodiment.

An inside of the developing container 41 is divided approximately at a center portion thereof into a developing chamber 41*a* and an agitating chamber 41*b* so as the developing chamber 41*a* and the agitating chamber 41*b* to be arranged in a horizontal direction by a partition wall 41*c* that extends in a vertical direction to a sheet surface of FIG. 3. The developer is stored in the developing chamber 41*a* and the agitating chamber 4*b*. That is, the partition wall 41*c* divides the inside of the developing container 41 into the developing chamber 41*a* serving as a first chamber and the agitating chamber 41*b* serving as a second chamber. The conveyance screws 43*a* and 43*b* are respectively disposed in the developing and agitating chambers 41*a* and 41*b*. Provided at both longitudinal end portions of the partition wall 41*c*, i.e., at end portions in a rotation axis direction of the developing sleeve 44 (see left and right sides in FIG. 4), are communicating portions 41*d* and 41*e* that permit the developer to pass between the developing chamber 41*a* and the agitating chamber 41*b*.

The conveyance screws 43*a* and 43*b* are formed with spiral blades serving as a conveyance portion, respectively, around a shaft, i.e., a rotational shaft, thereof. The conveyance screw 43*b* is provided, in addition to the spiral blade, with an agitation rib 43*b*1 that radially projects from the shaft and having a predetermined width in a conveyance direction of the developer. The agitation rib 43*b*1 agitates the developer along with the rotation of the shaft.

The conveyance screw 43*a* is disposed at a bottom of the developing chamber 41*a* along the rotation axis direction of the developing sleeve 44, and a rotational shaft thereof is rotated by a motor not illustrated to supply the developer to the developing sleeve 44 while conveying the developer within the developing chamber 41*a* in the rotation axis direction. The developer borne by the developing sleeve 44 and from which the toner has been consumed during the developing step is collected in the developing chamber 41*a*.

The conveyance screw 43*b* is also disposed at a bottom of the agitating chamber 41*b* along the rotation axis direction of the developing sleeve 44 and conveys the developer within the agitating chamber 41*b* in the rotation axis direction opposite to that of the conveyance screw 43*a*. The developer is thus conveyed by the conveyance screws 43*a* and 43*b* and circulates within the developing container 41 through the communicating portions 41*d* and 41*e*.

Figure 5:
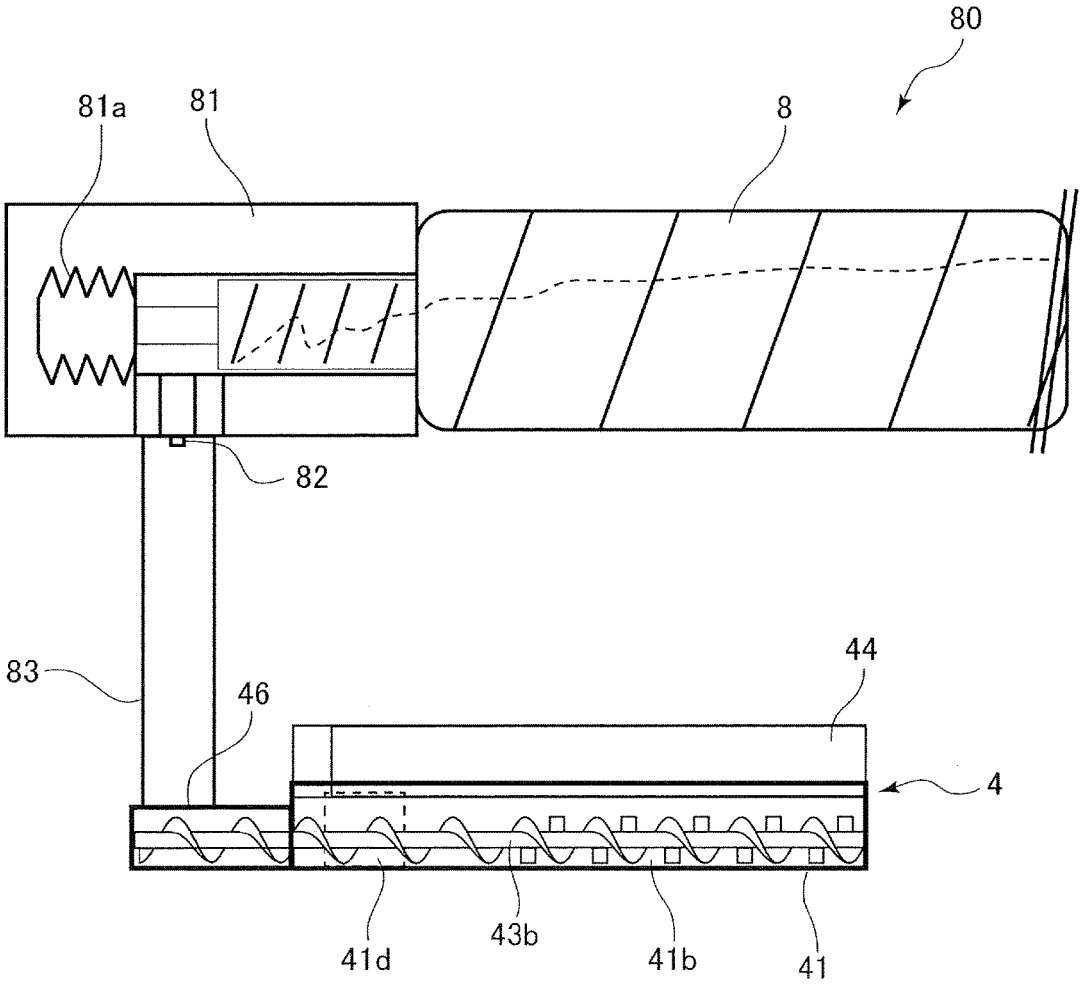
FIG. 5 is a schematic section view illustrating configurations of a replenishing apparatus and the developing apparatus of the first embodiment.

A developer replenishing port 46 configured to replenish the developer, containing the toner, into the developing container 41 is provided at an upstream end in the conveyance direction of the conveyance screw 43*b* in the agitating chamber 41*b*. The developer replenishing port 46 is connected with a replenishing conveyance portion 83 of the developer replenishing apparatus 80 as illustrated in FIG. 5 and described later. Accordingly, the replenishing developer is supplied into the agitating chamber 41*b* from the developer replenishing apparatus 80 through the replenishing conveyance portion 83 and the developer replenishing port 46. The conveyance screw 43*b* homogenizes toner concentration by conveying the developer while agitating the developer replenished from the developer replenishing port 46 and the developer existing already within the agitating chamber 41*b*.

Accordingly, the developer within the developing chamber 41*a* whose toner concentration has been lowered due to the consumption of the toner during the developing step is moved into the agitating chamber 41*b* through one communicating portion 41*d* (illustrated on a left side in FIG. 4) by a conveyance force of the conveyance screws 43*a* and 43*b*. Then, the developer which has been moved into the agitating chamber 41*b* is conveyed while being agitated with the replenished developer and is moved into the developing chamber 41*a* through the other communicating portion 41*e* (illustrated on a right side in FIG. 4).

An opening portion 41*h* is defined at a position corresponding to a facing area A, i.e., a developing area, facing the photosensitive drum 1 in the developing chamber 41*a* of the developing container 41, and the developing sleeve 44 is rotatably disposed such that a part thereof is exposed toward the photosensitive drum 1 through the opening portion 41*h*. Meanwhile, the magnet roller 44*a* disposed in the developing sleeve 44 is unrotatably fixed. The developing sleeve 44 constructed as described above is rotated by a motor not illustrated, can convey the developer to the facing area A and supply the developer to the photosensitive drum 1 through the facing area A. The developing sleeve 44 is formed into a cylindrical shape by a nonmagnetic material such as aluminum and stainless steel in the present embodiment. The developing sleeve 44 rotates upward from downward in terms of a gravity direction, i.e., counterclockwise in FIG. 3.

The developing blade 42 serving as a regulation member regulating an amount, i.e., a layer thickness, of the developer borne by the developing sleeve 44 is fixed upstream in the rotation direction of the developing sleeve 44 of the opening portion 41*h*. Because the developing sleeve 44 rotates upward from downward in the gravitation direction in the facing area A in the present embodiment, the developing blade 42 is positioned downward in the gravitation direction of the facing area A.

The magnet roller 44*a* is formed into a roller while having a plurality of magnetic poles S1, S2, S3, N1 and N2, i.e., five poles in total, in a circumferential direction thereof as illustrated in FIG. 3. The magnet roller 44*a* configured as described above generates a magnetic field bearing the developer on the developing sleeve 44 and a magnetic field that peels the developer off the developing sleeve 44 in a peeling area described later. That is, the developer within the developing chamber 41*a* is supplied to the developing sleeve 44 by the conveyance screw 43*a*. Then, a predetermined amount of the developer supplied to the developing sleeve 44 is borne on the developing sleeve 44 and forms a developer reservoir by a magnetic field generated by the attracting magnetic pole S2, i.e., a second magnetic pole, of the magnet roller 44*a*.

As the developing sleeve 44 rotates, the developer on the developing sleeve 44 passes through the developer reservoir and bristles at the regulating magnetic pole N1, i.e., a third magnetic pole, and a layer thickness of the developer is regulated by the developing blade 42 facing the regulating magnetic pole N1. Then the developer whose layer thickness has been regulated is conveyed to the facing area A facing the photosensitive drum 1 and forms a magnetic brush by being bristled at the developing magnetic pole S1. The magnetic brush comes into contact with the photosensitive drum 1 that rotates in the same direction with the developing sleeve 44 in the facing area A, and the electrostatic latent image is developed as a toner image by the charged toner.

After that, the developer on the developing sleeve 44 is conveyed into the developing container 41 as the developing sleeve 44 rotates while keeping the attraction of the developer on the surface of the developing sleeve 44 by the conveyance magnetic pole N2. Then, the developer borne on the developing sleeve 44 is peeled off the surface of the developing sleeve 44 in a peeling area formed by the homopolar peeling magnetic pole S3, i.e., a first magnetic pole, and the attracting magnetic pole S2 disposed sequentially in the rotation direction of the developing sleeve 44.

The peeled developer is collected in the developing chamber 41*a* of the developing container 41. The magnetic pole S2 is disposed so as to be adjacent to and downstream of the magnetic pole S3 in the rotation direction of the developing sleeve 44.

Figure 4:
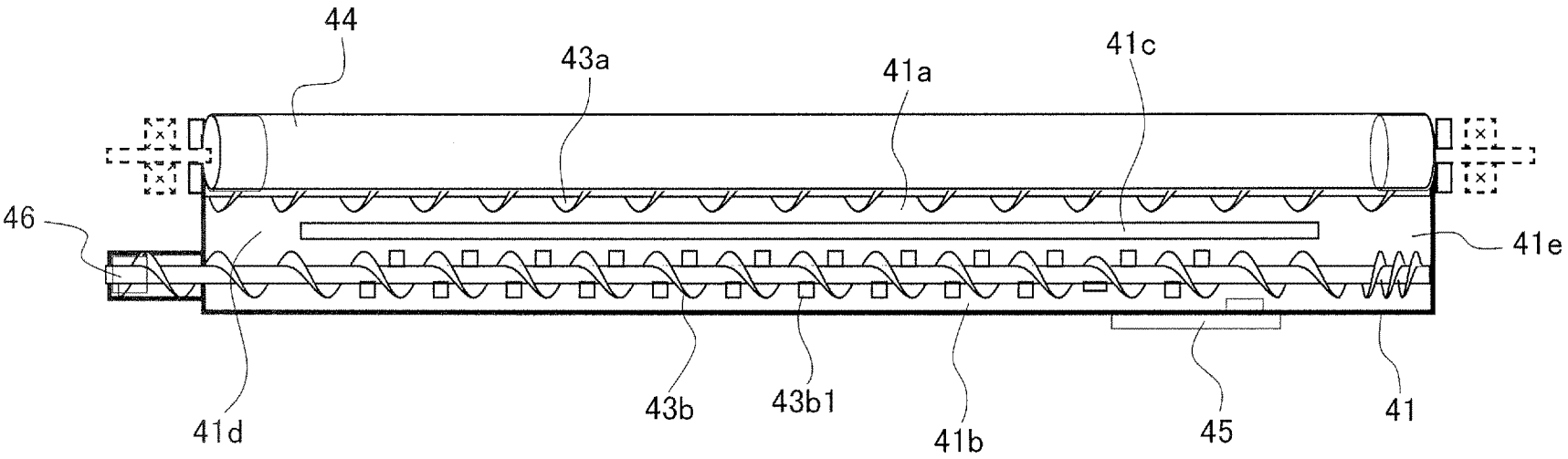
FIG. 4 is a schematic longitudinal section view illustrating the configuration of the developing apparatus of the first embodiment.

It is noted that the developing container 41 is provided with an inductance sensor 45 serving as a toner concentration sensor for detecting toner concentration within the developing container 41 as illustrated in FIG. 4. In the present embodiment, the inductance sensor 45 is provided downstream in the developer conveyance direction of the agitating chamber 41*b*.

Developer Replenishing Apparatus

Next, the developer replenishing apparatus 80 will be described with reference to FIG. 5. The developer replenishing apparatus 80 includes a storage container 8 configured to store replenishing developer, a replenishing mechanism 81 and a replenishing conveyance portion 83. The storage container 8 is configured such that a spiral groove is cut on an inner wall of the cylindrical container and generates a conveyance force for conveying the developer in a longitudinal direction, i.e., in a rotation axis direction, by rotation of the storage container 8 itself. A downstream end in a developer conveyance direction of the storage container 8 is connected with the replenishing mechanism 81. The replenishing mechanism 81 includes a pump portion 81*a* that discharges the developer conveyed from the storage container 8 through a discharge port 82. The pump portion 81*a* is formed into a bellow shape and generates air pressure by changing its capacity by being rotationally driven to discharge the developer conveyed from the storage container 8 through the discharge port 82.

An upper end portion of the replenishing conveyance portion 83 is connected with the discharge port 82 and a lower end portion thereof is connected with the developer replenishing port 46 of the developing apparatus 4. That is, the replenishing conveyance portion 83 communicates the discharge port 82 with the developer replenishing port 46. Accordingly, the developer discharged out of the discharge port 82 by the pump portion 81*a* is replenished into the developing container 41 of the developing apparatus 4 through the replenishing conveyance portion 83.

It is noted that in the developing apparatus 4 described above, the developer replenishing port 46 is provided at the upstream end in the developer conveyance direction of the developing container 41 and outside of the circulation path of the developer formed by the developing chamber 41*a* and the agitating chamber 41*b*. More specifically, the developer replenishing port 46 is provided on the upstream side in the developer conveyance direction of the agitating chamber 41*b* beyond one communicating port 41*d*. Accordingly, barely no developer that is to be circulated in the circulation path exists in the vicinity of the developer replenishing port 46, and only the replenishing developer passes through there.

A replenishing operation of the developer replenishing apparatus 80 is performed by automatic toner replenisher control (referred to as 'ATR' hereinafter). The ATR control is what replenishes the developer to the developing apparatus 4 by controlling operations of the developer replenishing apparatus 80 in accordance with an image ratio in forming an image, the inductance sensor 45 and a detection result of concentration of a patch image detected by a concentration sensor 103 (see FIG. 1) that detects concentration of a toner image.

As illustrated in FIG. 1, the concentration sensor 103 is disposed so as to face the surface of the intermediate transfer belt 51 downstream of the most downstream image forming portion PK and upstream of the secondary transfer portion T2 in a rotational direction of the intermediate transfer belt 51. In a control using the concentration sensor 103, a control toner image, i.e., a patch image, is transferred onto the intermediate transfer belt 51 with timing in starting an image forming job or in every time in forming images of a predetermined number of sheets to detect concentration of the patch image by the concentration sensor 103. Then, based on the detection result, the developer replenishing apparatus 80 is controlled to replenish the developer.

It is noted that the configuration of replenishing the developer to the developing apparatus 4 is not limited to the configuration described above and a configuration known since the past may be used.

Scattering of Developer

Scattering of the developer generated from the developing apparatus will be described now. At first, an image forming apparatus is required to output images in high speed, to output high-quality images and to simplify its maintenance. One of the simplifications of the maintenance is reduction of contamination caused by the developer within the image forming apparatus. If the inside of the image forming apparatus is contaminated by the developer, image defects such as soiling of an output image occurs or cleaning works are required in replacing such devices as the developing apparatus and the photosensitive drum unit. Still further, in a case where the developer adheres to each driving system such as a gear, there is a possibility of causing slips in the driving system.

One of the causes of contamination by the developer within the image forming apparatus constructed as described above is scattering of the developer out of the developing apparatus. For instance, in a case of the two-component developer, the toner and the carrier normally adhere with each other by an electrostatic force within the developing apparatus because the toner and the carrier are frictionally charged. However, there is a possibility that the adhesion is released by some impact and the toner isolated from the carrier is discharged together with airflow out of the developing apparatus, thus causing scattering of the developer.

Figure 6:
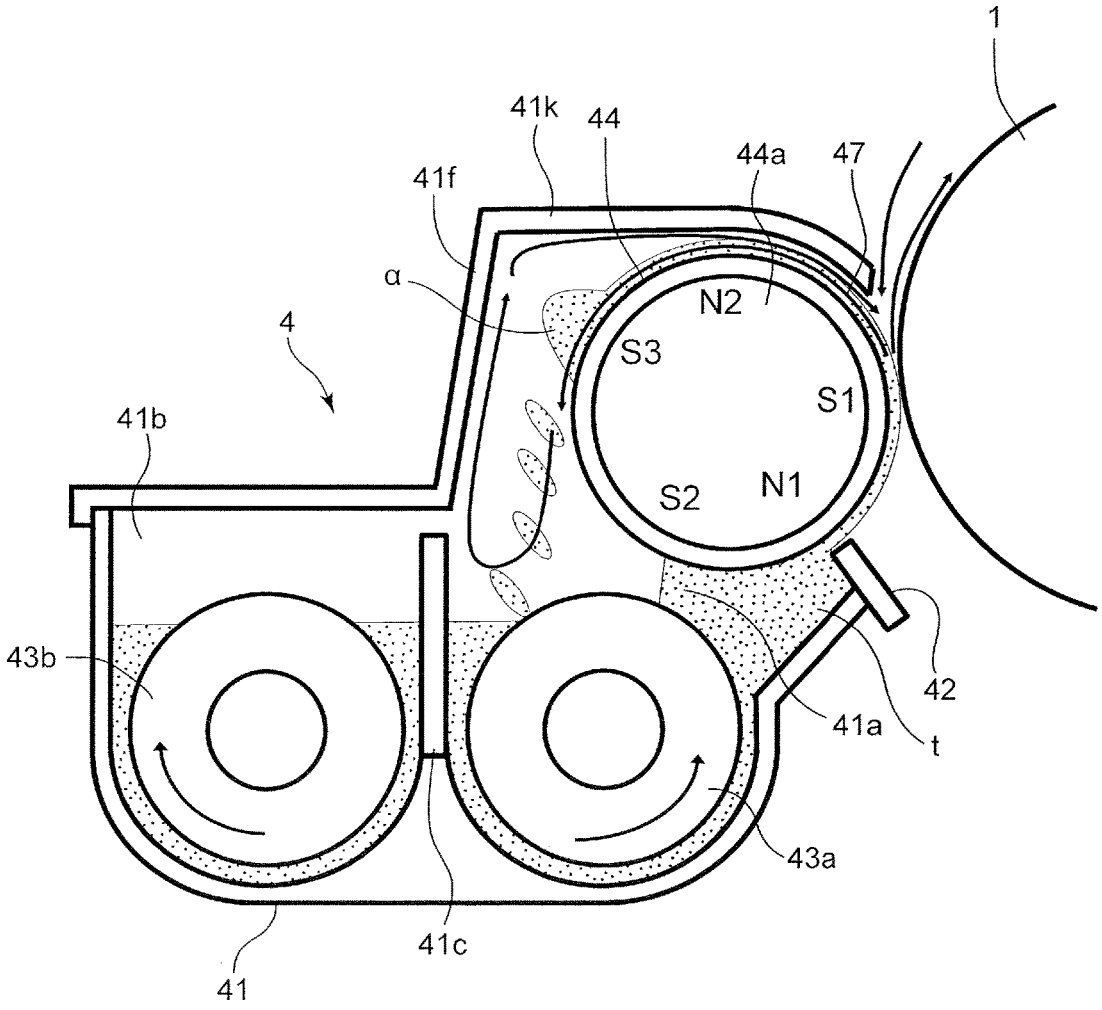
FIG. 6 schematically illustrates a condition of the developer and airflows for describing scattering of toner in the developing apparatus.

Scattering of the developer as described above will be described below with reference to FIG. 6. It is noted that arrows indicate flows of airflows and satin parts indicate the developer tin FIG. 6. The developing container 41 includes an upper wall 41*k* covering an upper part of the developing sleeve 44. A path of air flowing into the developing container 41 is formed by the rotation of the developing sleeve 44 at a communication opening 47 communicating inside and outside of the developing container 41 and defined by the upper wall 41*k* and the developing sleeve 44. This path is opened at the position facing the photosensitive drum 1, and scattering of the developer out of the developing container 41 occurs mainly from this path. It is because the developing blade 42 faces the developing sleeve 44 in close proximity on a side (lower side in FIG. 6) opposite from this path. That is, the layer thickness of the developer borne on the developing sleeve 44 is regulated by the developing blade 42 at this position, and air is hardly flown out from a gap between the developing sleeve 44 and the developing blade 42.

Here, 'scattering of the developer' refers to a condition in which the developer such as the isolated toner generated within the developing container 41 due to the agitation and conveyance of the developer or the replenishment of the developer is discharged out of the developing container 41 through the opening of the path and cannot be collected within the developing container 41.

At first, the isolation of the toner will be described. The toner and the carrier stored in the developing container 41 are frictionally charged in the agitating chamber 41*b* and the developing chamber 41*a* and adhere with each other by an electrostatic adhesive force generated by frictional charge and a non-electrostatic adhesive force generated by surface nature. If an impact or a shearing force is applied to the toner adhering with the carrier, the toner is separated from the carrier and is isolated within the developing container 41. The impact and the shearing force at this time may be caused by behavior of the developer conveyed by the developing sleeve 44.

The developer forms the magnetic brush on the developing sleeve 44. The magnetic brush has a structure of a chain along a magnetic line of force of the magnetic pole in the developing sleeve 44. The magnetic brush rises up forward in the rotation direction right before the magnetic pole by the rotation of the developing sleeve 44 and falls down forward in the rotation direction after passing through the magnetic pole. At this time, the direction in which the magnetic brush falls down is the same with the rotation direction of the developing sleeve 44. The impact or inertia caused when the magnetic brush falls down is one of the causes of isolation of toner because the toner is separated from the carrier at this time.

A magnetic pole that largely contributes to the isolation of the toner in the conveyance of the developer by the developing sleeve 44 is the peeling magnetic pole S3 that generates a repulsive magnetic field with the attracting magnetic pole S2. At the peeling magnetic pole S3, a magnetic force reverse to the rotation direction of the developing sleeve 44 is applied by the magnetic pole to drop speed of the conveyed developer and to retain the developer in order to peel the developer off the developing sleeve 44. Then, a developer retained portion (developer accumulation) a is formed centering on a point where magnitude of a magnetic field of the peeling magnetic pole S3 in a normal component of the developing sleeve 44 is maximized (tangential component is minimized) along the circumferential surface of the developing sleeve 44. At this time, because a flow amount of the developer conveyed on the surface of the developing sleeve 44 is kept, the length of the magnetic brush becomes longer. When the magnetic brush becomes longer, the impact and inertia when the magnetic brush falls down become large and the toner isolation amount tends to increase. It is noted that because the impact when the magnetic brush falls down occurs also at the developing magnetic pole S1 and the conveyance magnetic pole N2, isolation of toner occurs also at the developing magnetic pole S1 and the conveyance magnetic pole N2 even though their amounts are smaller than that generated by the peeling magnetic pole S3.

Still further, when the developer is replenished from the developer replenishing apparatus 80 to the developer replenishing port 46, the developer flown up before fully agitated also becomes a factor of generating the isolated toner within the developing container 41. The toner supplied to the developer replenishing port 46 is conveyed while being agitated with developer already existing within the agitating chamber 41*b*. At this time, a mixture ratio of the toner and the developer becomes temporarily high in a mixture region of the replenished developer and the existing developer. In a case where the mixture ratio of the toner and the developer is high, an electric charge amount of the toner drops, and the electrostatic adhesive force between the toner and the carrier also drops. The toner that cannot be mixed with the developer is isolated as it is or is isolated by the impact at the time of agitation and conveyance of the developer by the conveyance screws 43*a* and 43*b* and the isolated toner is flown up within the developing container 41.

In a case where the developer replenishing apparatus 80 out of which the developer is discharged by air pressure generated by the pump portion 81*a* is used, there is a case where the air pressure propagates through the replenishing conveyance portion 83 and causes air flown into the developing container 41 from the developer replenishing port 46. The airflow flown in at this time flies up the isolated toner at the part where the mixture ratio of the toner and the developer is high in the vicinity of the developer replenishing port 46 within the developing container 41. This propagation of the air pressure to the developing container 41 also increases non-stationary air pressure from the developer replenishing port 46 to the agitating chamber 41*b*. The increase of the air pressure becomes a factor of flowing the isolated toner out of the developing container 41 as described later. The flown-in air caused by the replenishment of the developer becomes one factor of scattering the developer at an end portion including the developer replenishing port 46 in relation to the longitudinal direction of the developing container 41, i.e., a direction intersecting with the rotation direction of the developing sleeve 44 or the rotation axis direction.

Next, airflows within and in a vicinity of the developing apparatus 4 will be described. What generate the airflow in the vicinity of the developing apparatus 4 are the developing sleeve 44 and the photosensitive drum 1. Their operations will be described here, respectively. Airflow is generated approximately in a same direction with the rotation direction of the developing sleeve 44 by the rotation of the developing sleeve 44 and the behaviors of the magnetic brush on the magnetic poles. The airflow generated approximately in the same direction with the rotation direction of the developing sleeve 44 is caused by taking air into the developing container 41 from the communication port 47 communicating within and without the developing container 41. Air is also flowed into the developing container 41 in replenishing the developer.

If the developing container 41 is assumed to be an approximately closed space, an equation of continuity can be applied because air is fluid. Then the following equation (1) holds, where v is flow rate of the air and ρ is density thereof:

$$\partial\rho/\partial t+\nabla\rho v=0 \quad (1)$$

Still further, because an internal pressure is constant and is stabilized in a condition of being higher than the atmospheric pressure if a stationary state is considered, the density ρ is considered to have no time variation in each area in the developing container 41, and the equation (1) can be described as the following equation (2):

$$\rho\nabla v=0 \quad (2)$$

From the equation (2), a flow amount of the air pv is preserved. A balance of the flow amount pv is zeroed at a cross section in the longitudinal direction in the vicinity of the developing apparatus 4, and a same amount of air with the air flow amount flown in by the developing sleeve 44 and the replenishment is discharged out of the developing apparatus 4. Here, an airflow amount flown into the developing container 41 by the rotation of the developing sleeve 44 through the communication port 47 composed of the upper wall 41*k* of the developing container 41 and the developing sleeve 44 is considered to be Ia (flow-in by sleeve). The airflow discharged through the communication port 47 communicating within and without the developing container 41 passes through the upper wall 41*k* side as opposed to the flow taken in through the communication port 47. An airflow amount thus discharged is considered to be Ib (discharged from sleeve). Still further, an airflow amount flown in along with the replenishment to the developing apparatus 4 is considered to be Id (flow-in with replenishment), a relationship of the following equation (3) holds:

$$Ia(\text{flow-in by sleeve})+Id(\text{flow-in with replenishment}) = Ib(\text{discharged from sleeve}) \quad (3)$$

The airflow taken in by the developing sleeve 44 and flowing along the developing sleeve 44 is returned within the developing container 41 and is discharged out of the developing container 41. If the airflow is returned while containing the developer peeled off the developing sleeve 44 at the developer retained portion α of the peeling magnetic pole S3 at this time, the airflow heads in the discharge direction while containing much developer such as the isolated toner generated within the developing container 41.

Airflow in Longitudinal Direction of Developing Apparatus

Next, the airflow in the longitudinal direction in the vicinity of the developing apparatus 4 will be described with reference to FIG. 7. Arrows in FIG. 7 indicate flows of airflows within the developing apparatus 4. The balance of the airflows is kept in the condition in which the internal pressure of the developing container 41 is raised as described above. In the balance of the airflows, the developer accumulated in the vicinity of the peeling magnetic pole S3 generating the repulsive magnetic field, i.e., the developer retained portion α in FIG. 6, restricts a path of the airflow and causes a pressure loss on the airflow amount Ib discharged through the upper wall 41*k* side within the developing container 41.

An amount of the developer at the developer retained portion α in the vicinity of the peeling magnetic pole S3 differs depending on longitudinal positions of the developing container 41. There is more of the developer at the developer retained portion α in the vicinity of the peeling magnetic pole S3 at a longitudinal center portion of the developing container 41 which is a position indicated by L1 in FIG. 7. In a developing apparatus used for observation which was the same one used for the verification experiment described later, a distance between the developer retained portion α and the developing container 41 was about 2 mm. Meanwhile, there was less of the developer in the developer retained portion α in the vicinity of the peeling magnetic pole S3 at both longitudinal end portions of the developing container 41 which are positions indicated by L2 and L3 in FIG. 7 as compared to the longitudinal center portion. Therefore, a distance between the developer retained portion α and the developing container 41 was about 3 mm.

It is noted that the distance between the developer retained portion α and the developing container 41 is defined by a shortest distance between a tip of the developer retained portion α formed as follows and a wall portion 41*f* of the developing container 41 facing this tip. The wall portion 41*f* is disposed on an opposite side of the photosensitive drum 1 while interposing the developing sleeve 44 and above the partition wall 41*c* and the developing chamber 41*a*, and an upper end thereof continues to the upper wall 41*k*. In measuring the distance between the developer retained portion α and the developing container 41, the developing apparatus 4 is driven for a predetermined time, e.g., a time of more than a time required for forming an image on one A4 size sheet, in a condition in which the developing apparatus 4 is installed at an angle, e.g., horizontal, normally used and is halted in a same manner with the verification experiment described later. At this time, the developer retained portion α is formed in a condition of being borne on the developing sleeve 44 in the vicinity of the peeling magnetic pole S3 as illustrated in FIG. 6 among the developer borne around the peripheral surface of the developing sleeve 44. Because the distance between the developing sleeve 44 and the developing container 41 is known, the distance between the developer retained portion α and the developing container 41 can be measured by measuring a height of the developer retained portion α.

Figure 8:
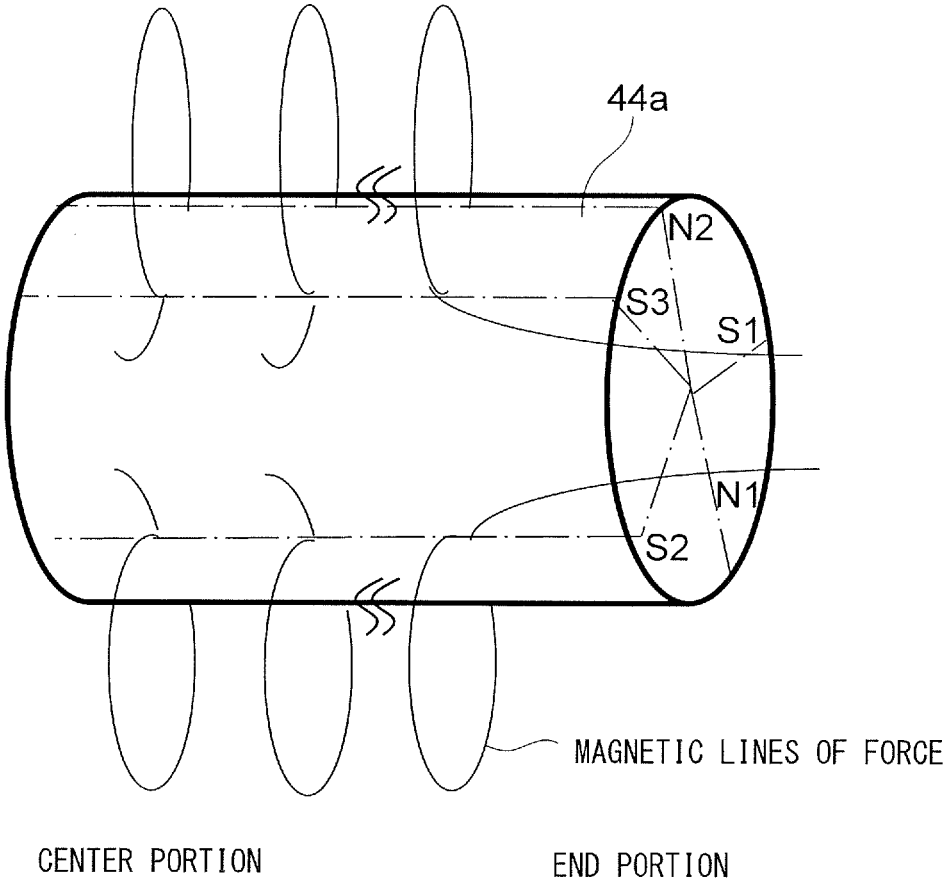
FIG. 8 schematically illustrates magnetic lines of force at a center and end portions of a magnetic roller.

In general, it is known that magnetic lines of force of the adjacent homopolar magnetic poles, e.g., the peeling magnetic pole S3 and the attracting magnetic pole S2 here, of the magnet roller 44*a* extend without crossing with each other as illustrated in FIG. 8. Because the magnetic field is uniform in the longitudinal direction at the longitudinal center portion of the developing sleeve 44 within which the magnet roller 44*a* is disposed, magnetic lines of force from the peeling magnetic pole S3 stay within a cross section orthogonal to a center line of the magnet roller 44*a*.

However, because there exists no magnetic pole outside of an end face of the magnet roller 44*a* at both longitudinal end portions of the developing sleeve, magnetic lines of force from the peeling magnetic pole S3 do not stay within the cross section orthogonal to the center line of the magnet roller 44*a*. Then, the magnetic lines of force from the peeling magnetic pole S3 extend three-dimensionally toward an end portion of the developing sleeve 44. Due to that, the magnetic brush of the developer retained portion α in the vicinity of the peeling magnetic pole S3 strays in a direction of the end portion of the developing sleeve 44 by being influenced by the magnetic line of force.

As a result, the amount of the developer of the developer retained portion α in the vicinity of the peeling magnetic pole S3 at both longitudinal end portions of the developing sleeve 44 becomes relatively smaller than the amount of the developer of the developer retained portion α in the vicinity of the peeling magnetic pole S3 at the longitudinal center portion. Areas of both longitudinal end portions where the amount of developer of the developer retained portion α is less are areas of equal to or less than 10%, e.g., equal to or less than 40 mm, of a length of a developer bearing area, i.e., a coating area, where the developing sleeve 44 bears the developer at most from the both ends of the coating area. It is noted that the coating area is an area where the developer is borne on the surface of the developing sleeve 44, and in a case where regulation plates, e.g., a magnetic plate, that regulate the developer bearing area are arranged at the both end portions of the developing sleeve 44, positions of the regulation plates are both ends of the coating area.

Figure 7:
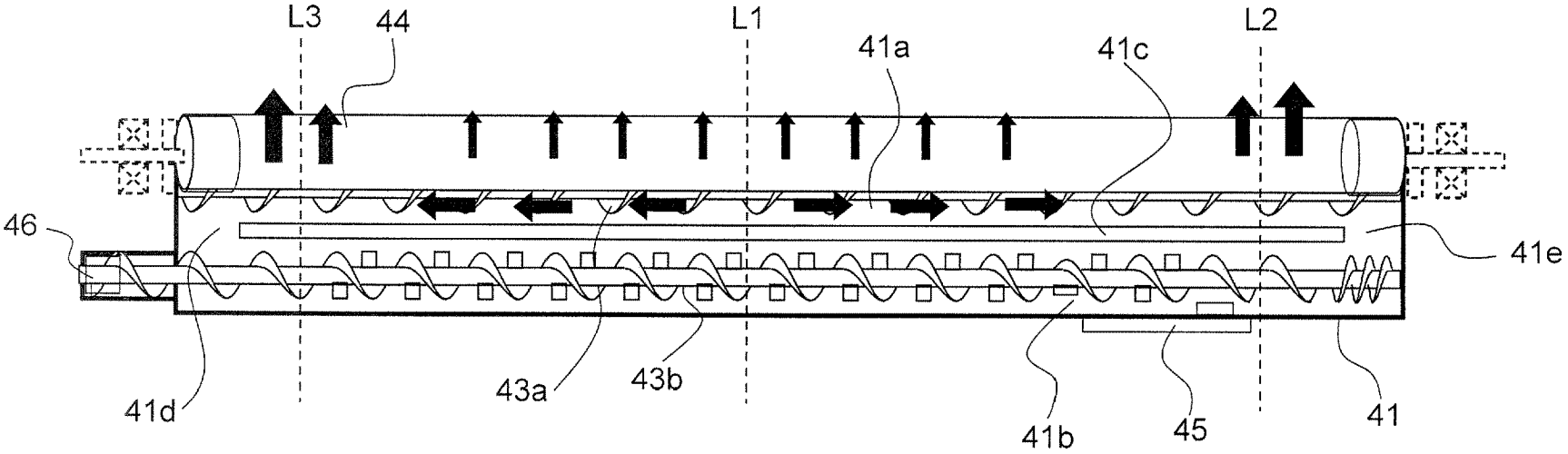
FIG. 7 schematically illustrates airflows in the longitudinal direction of the developing apparatus.

If the amount of developer of the developer retained portion α is smaller at both longitudinal end portions more than that of the longitudinal center portion, the paths in the cross sections orthogonal to the longitudinal direction, i.e., the rotation axis direction, of the developing sleeve 44 at both longitudinal end portions are wider than those of the longitudinal center portions as illustrated by the arrows in FIG. 7. Accordingly, the airflows are hard to be discharged with regard to the increase of the internal pressure of the developing container 41 relatively at the longitudinal center portion and are easy to be discharged at the longitudinal both end portions. Then, horizontal airflows heading from the longitudinal center portion to both longitudinal end portions are generated in a space downstream the peeling magnetic pole S3 in relation with the rotation direction of the developing sleeve 44 within the developing container 41. As a result, amounts of airflows discharged out of the communication port 47 (see FIG. 6) communicating within and without the developing container 41 at both longitudinal end portions of the developing container 41 become larger than that of the longitudinal center portion, and scattering of the toner increases at both longitudinal end portions.

Distance between Developing Container and Developing Sleeve

Figure 9:
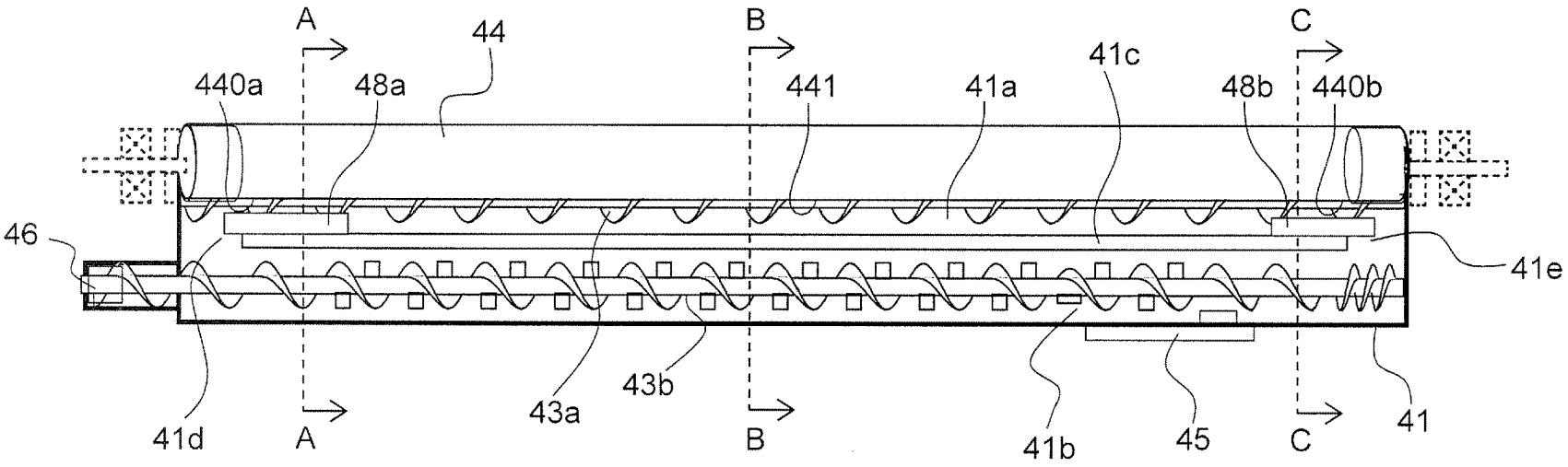
FIG. 9 is a schematic longitudinal section view of the configuration of the developing apparatus of the first embodiment taken so as to include projections at both longitudinal end portions of the developing apparatus.
Figure 10A:
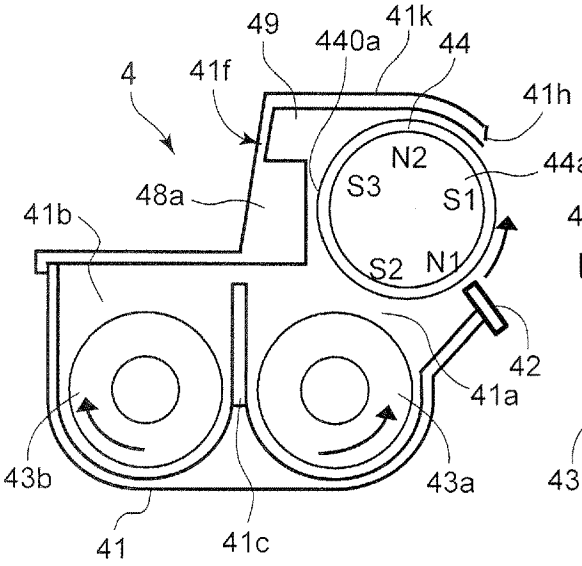
FIG. 10A is a section view of the developing apparatus taken along a line A-A in FIG. 9.
Figure 10B:
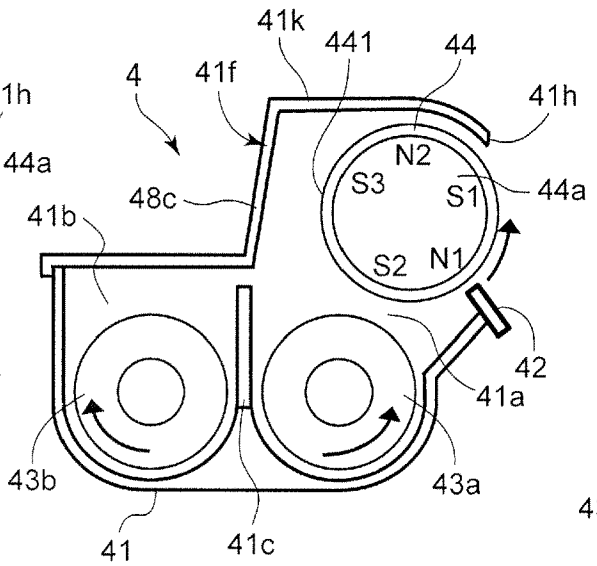
FIG. 10B is a section view of the developing apparatus taken along a line B-B in FIG. 9.
Figure 10C:
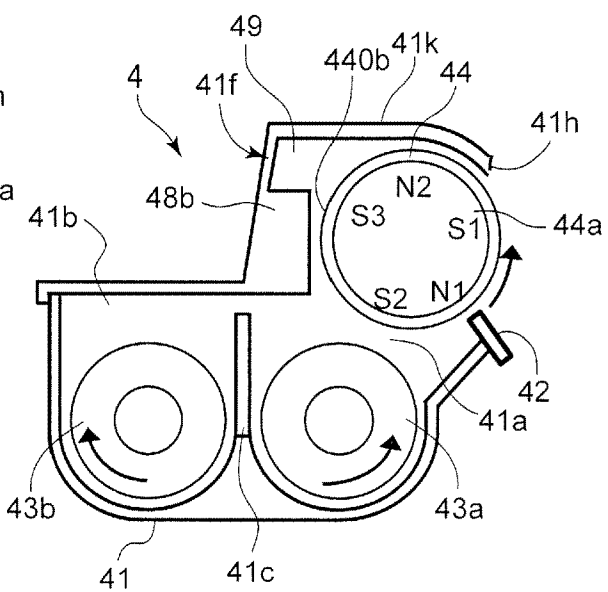
FIG. 10C is a section view of the developing apparatus taken along a line C-C in FIG. 9.
Figure 11:
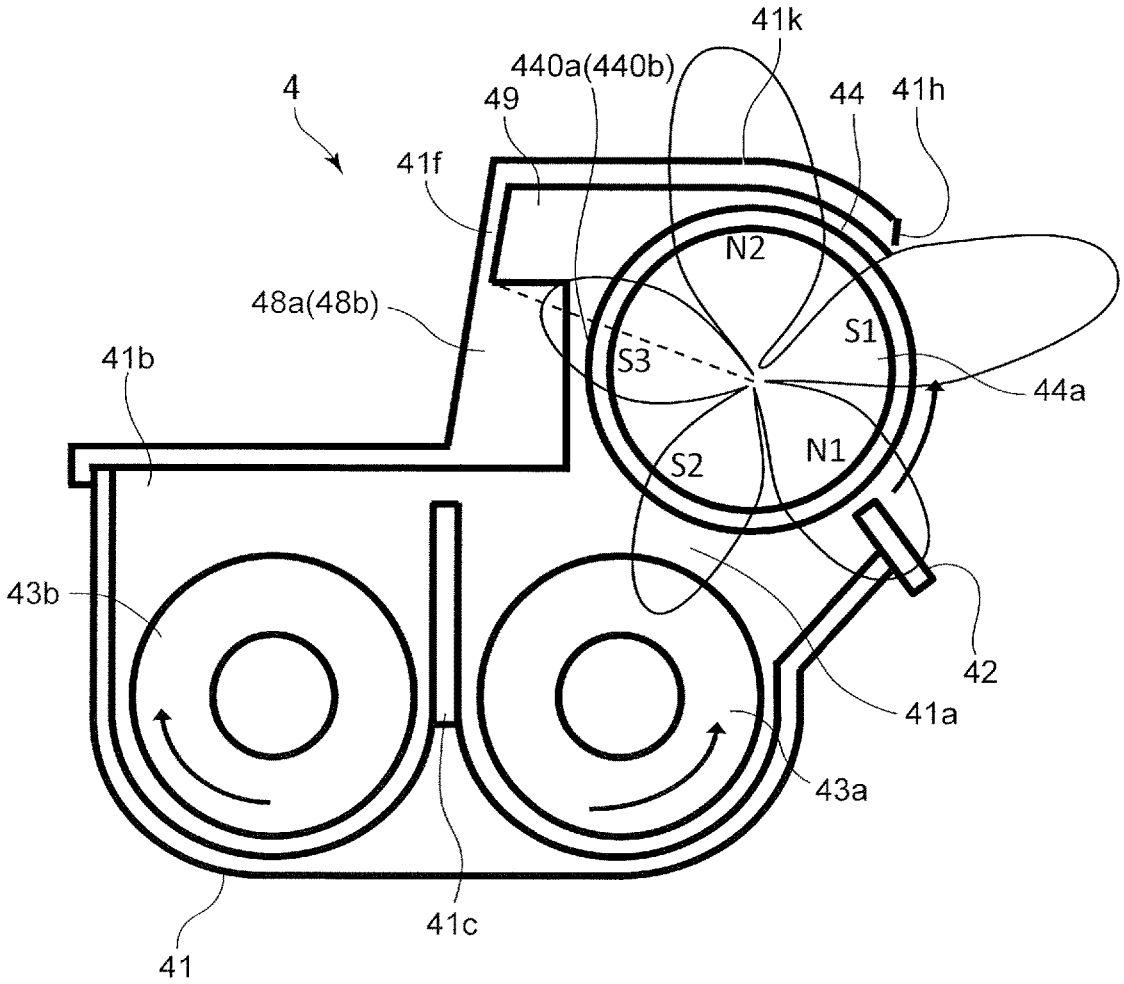
FIG. 11 is a schematic transverse section view of the configuration of the developing apparatus in which the magnetic lines of force of the magnet roller of the first embodiment are schematically illustrated.
Figure 12:
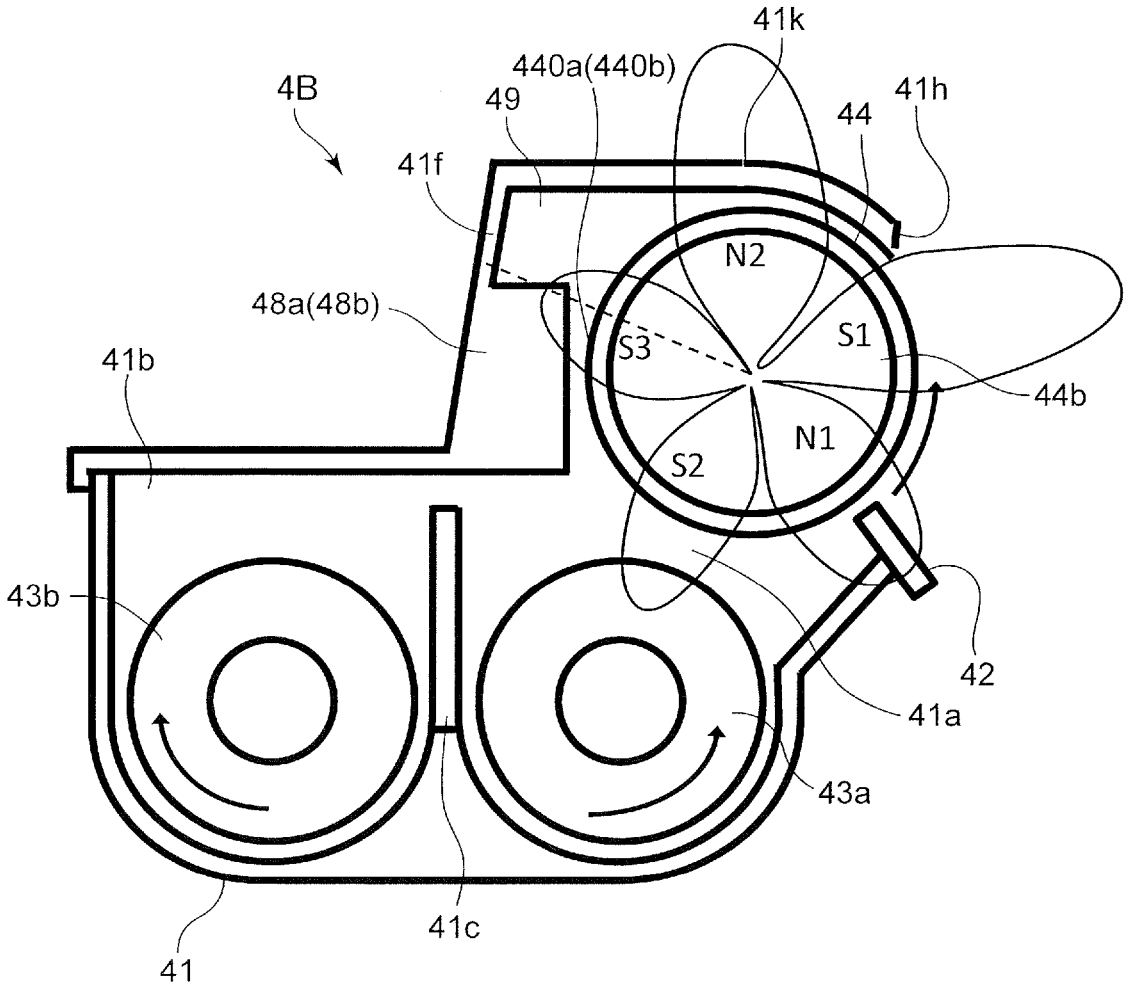
FIG. 12 is a schematic transverse section view of the configuration of the developing apparatus in which the magnetic lines of force of the magnet roller of another example of the first embodiment are schematically illustrated.

Then, in the present embodiment, the distance between the developing container 41 and the developing sleeve 44 is varied in the longitudinal positions of the developing container 41. This point will be described with reference to FIGS. 9 through 12. Here, FIG. 9 is a section view illustrating the configuration of the developing apparatus 4 taken horizontally so as to include projections 48*a* and 48*b* of the wall portion 41*f* as described later. Still further, FIG. 10A is a section view taken along a position L3 in FIG. 7, FIG. 10B is a section view taken along a position L1 in FIG. 7 and FIG. 10C is a section view taken along a position L2 in FIG. 7. FIG. 11 is a section view of the developing apparatus schematically illustrating the magnetic lines of force of the magnet roller 44*a* at the positions L2 and L3 in FIG. 7. FIG. 12 illustrates another example of the present embodiment and schematically illustrates the magnetic lines of force of a magnet roller 44*b* at the positions L2 and L3 in FIG. 7. It is noted that a configuration of the developing apparatus 4B of the other example illustrated in FIG. 12 is the same as that of the developing apparatus 4 of the present embodiment other than the magnetic lines of force of the developing sleeve 44*b*. As illustrated in FIG. 9, outer ends of the projections 48*a* and 48*b* in the rotation axis direction of the developing sleeve 44 are located outside of ends of the end portions of the coating area bearing the developer. However, the present embodiment is not limited to this configuration and the outer ends of the projections 48*a* and 48*b* in the rotation axis direction may be substantially aligned with the end portions of the coating area. That is, the outer ends of the projections 48*a* and 48*b* in the rotation axis direction may deviate by around ±1 mm with respect to the ends of the coating area.

The discharged airflows increase at both longitudinal end portions of the developing apparatus 4 because the amounts of developer of the developer retained portions a in the vicinity of the peeling magnetic pole S3 at both longitudinal end portions are smaller than that of the longitudinal center portion and the pressure loss is small as described above. Then, in the present embodiment, the paths of these areas are narrowed to increase pressure loss and to reduce a toner amount scattering from these areas. That is, the paths are narrowed by bringing a distance G between the surface of the developing sleeve 44 in the vicinity of the peeling magnetic pole S3 and the wall portion 41*f* of the developing container 41 facing thereto closer at both longitudinal end portions as compared to that of the longitudinal center portion.

Specifically, in the vicinity of the peeling magnetic pole S3 of the bearing area, i.e., the coating area, in which the developing sleeve 44 bears the developer, the developing container 41 is configured such that distances, i.e., shortest distances, from a pair of end areas 440*a* and 440*b* are reduced as compared to a distance from a center area 441. That is, the wall portion 41*f* of the developing container 41 is disposed so as to face the developing sleeve 44 at an area downstream of the peeling magnetic pole S3 and upstream of the attracting magnetic pole S2 in the rotation direction of the developing sleeve 44. Still further, the wall portion 41*f* is configured such that the gaps with the respective end portions of the coating area in the longitudinal direction of the developing sleeve 44 are smaller than the gap with the center portion of the coating area. Ranges of the pair of end areas 440*a* and 440*b* will be described later. The center area 441 is an area on the center side more than the pair of end areas 440*a* and 440*b* in terms of the longitudinal direction.

Therefore, according to the present embodiment, the wall portion 41*f* of the developing container 41 includes the projections 48*a* and 48*b*, i.e., end wall portions, that project toward the developing sleeve 44 more than a center portion 48*c* facing the center area 441 at parts facing the pair of end areas 440*a* and 440*b*. That is, as illustrated in FIGS. 10A, 10C 11 and 12, the projections 48*a* and 48*b* that project toward the developing sleeve 44 are formed at both longitudinal end portions of the wall portion 41*f* of the developing container 41 that are parts facing the pair of end areas 440*a* and 440*b*. Meanwhile, as illustrated in FIG. 10B, no such projection is formed at the center portion 48*c* in the longitudinal direction of the wall portion 41*f* which is a part facing the center area 441. While the wall portion 41*f* having the projections 48*a* and 48*b* and the partition wall 41*c* are configured separately in the present embodiment, the wall portion 41*f* and the partition wall 41*c* may be molded in a body. In this case, the center portion 48*c* of the wall portion 41*f* may be formed to be the partition wall 41*c*, and the projections 48*a* and 48*b* may be attached to the wall portion 41*f*

The area in the vicinity of the peeling magnetic pole S3 described above is an area which includes a point, i.e., a peak position, where at least a normal component, which is a component in the normal direction of the developing sleeve 44, of the magnetic field of the peeling magnetic pole S3, i.e., the first magnetic pole, becomes maximized on the surface of the developing sleeve 44 in the rotation direction of the developing sleeve 44. That is, as illustrated in FIGS. 11 and 12, the projections 48*a* and 48*b* are formed so as to face at least the area including the peak position of the peeling magnetic pole S3 in the radial direction of the developing sleeve 44 as illustrated by a broken line. An upper end of the projection 48*a* or 48*b* is located at a position higher than a peak position of magnetic flux density of the peeling magnetic pole S3 on the developing sleeve 44, i.e., a point where the broken line in FIG. 12 intersects with the surface of the developing sleeve, in a perpendicular direction. Still further, a lower end of the projection 48*a* or 48*b* is located at a position higher than a peak position of magnetic flux density of the attracting magnetic pole S2 on the developing sleeve 44 in the perpendicular direction. Still further, the peak position of the magnetic flux density of the peeling magnetic pole S3 on the developing sleeve 44, i.e., the point where the broken line in FIG. 12 intersects with the surface of the developing sleeve, is located at a position facing the projection 48*a* or 48*b* horizontally. Then, a peak position of the magnetic flux density of the magnetic pole S2 on the developing sleeve 44 is located at a position not facing the projection 48*a* or 48*b* horizontally.

Still further, the areas where the distances between the developing container 41 and the pair of end areas 440*a* and 440*b* are smaller than that of the center area 441, i.e., the areas of the projections 48*a* and 48*b*, are preferable to areas including a half-value width of the magnetic force of the peeling magnetic pole S3 in terms of the cross-section direction of the developing sleeve 44. That is, the areas of the projections 48*a* and 48*b* are preferred to face the areas including the half-value width of the magnetic force of the peeling magnetic pole S3 in terms of the rotation direction of the developing sleeve 44.

This reason will be described below. As for the rotation direction of the developing sleeve 44 at first, it is desirable to bring the developing container 41 and the developing sleeve 44 closer so as to cover a part bristling most in the developer retained portion α in the vicinity of the peeling magnetic pole S3. In a case where the developing container 41 is brought closer to the developing sleeve 44, an occurrence of an accumulation of the developer and a contact of the developing sleeve 44 with the developing container 41 by component tolerance are concerned. For instance, in a case where the gap between the opening portion 41*h* of the developing container 41 and the developing sleeve 44 is reduced, the developing sleeve 44 is liable to come into contact with the developing container 41 by the component tolerance. Still further, in this case, there is a possibility that the developer borne on the developing sleeve 44 is separated to those within and without the developing container 41 and thus the developer scatters to the outside of the developing container 41. Due to that, it is hard to reduce the gap between the opening portion 41*h* and the developing sleeve 44.

Meanwhile, the part where the developer bristles most in the developer retained portion α in the vicinity of the peeling magnetic pole S3 is the point where the normal component of the developing sleeve 44 of the magnitude of the magnetic field of the peeling magnetic pole S3 is maximized in the developer retained portion α. Due to that, it is possible to increase the pressure loss of the path through which the airflow flows by the part where the developer in the developer retained portion α bristles most and the developing container 41 by bringing the developing container 41 closer to the part without bringing the developing container 41 closer to the developing sleeve 44 so much. Still further, if the distance between the developing container 41 and the developing sleeve 44 can be assured by a certain degree, it is possible to suppress the developing sleeve 44 from coming into contact with the developing container 41 by the component tolerance.

The part where the developer in the developer retained portion α in the vicinity of the peeling magnetic pole S3 bristles most is a part where the developer conveyance force on the surface of the developing sleeve 44 is strong and bulk density of the developer is low. Due to that, accumulation of the developer hardly occurs even if the gap of the part is reduced. In contrary to that, no developer conveyance force of the developing sleeve 44 is obtained in a part downstream in the rotation direction of the developing sleeve 44 of the part where the developer in the developer retained portion α of the peeling magnetic pole S3 bristles most and in which a magnetic force in a direction of the rotational center of the developing sleeve 44 becomes 0 N or less due to the influence of the attracting magnetic pole S2. That is, the magnetic force acts as a repulsive force in a direction of separating from the developing sleeve 44 in the part, and it is unable to obtain the effect of the developer conveyance force of the developing sleeve 44 after when the developer separates from the developing sleeve 44. Due to that, there is a possibility that the developer accumulates if the developing container 41 is brought closer to the developing sleeve 44 too much in the part.

Therefore, the position where the developing container 41 is brought closer to the developing sleeve 44 is preferable to be the point where the developer is borne on the developing sleeve 44 upstream in the rotation direction of the developing sleeve 44 rather than the point where the magnetic force in the rotational center direction of the developing sleeve 44 becomes 0 N or less due to the influence of the repulsive area. Still further, the part where the developer bristles most on the developing sleeve 44 is the part where the magnetic line of force generated in the vicinity of the peeling magnetic pole S3 is approximately vertical to the developing sleeve 44, i.e., vertical to a moving direction caused by the rotation of the developing sleeve 44.

In a case where the magnitude of the magnetic field on the developing sleeve 44 is divided into the tangential component and the normal component of the developing sleeve 44, the developer bristles most at the point where the normal component of the magnitude of the magnetic field is maximized, i.e., the point where the tangential component is minimized. Accordingly, it can be seen that the positions where the developing container 41 is brought closer to the developing sleeve 44, i.e., the positions where the projections 48*a* and 48*b* are formed, are preferable to be areas at least including the point where the normal component of the magnitude of the magnetic field of the peeling magnetic pole S3 is maximized in relation to the rotation direction of the developing sleeve 44. It is possible to effectively enhance the pressure loss of the airflow flowing through the part by bringing the developing container 41 closer to the developing sleeve 44 in the area.

Lengths in the rotation direction of the developing sleeve 44 of the projections 48*a* and 48*b*, i.e., vertical lengths in FIGS. 10A, 10C, 11 and 12 for convenience of the description, are set as follows. While a space 49 is defined above the projections 48*a* and 48*b* and between the upper wall 41*k* in FIGS. 10A, 10C, 11 and 12, the projections 48*a* and 48*b* may be formed to be continuous from the upper wall 41*k*. Still further, while lower ends of the projections 48*a* and 48*b* in FIGS. 10A, 10C, 11 and 12 are leveled with a lower end of the wall portion 41*f*, the position of the lower end of the projections may be above or under the position of the wall portion 41*f* as long as the abovementioned conditions are met.

However, the lower end position of the projection is set at most within the peak position of the attracting magnetic pole S2, i.e., the position where the normal component of the developing sleeve 44 of the magnitude of the magnetic field of the attracting magnetic pole S2 is maximized. In the present embodiment, the lower ends of the projections 48*a* and 48*b* are positioned at positions including a horizontal line passing through the peak position of the attracting magnetic pole S2 and above the horizontal line.

Reasons why the upper and lower ends of the projections 48*a* and 48*b* are restricted as described above are to increase the length in the vertical direction, i.e., the rotation direction of the developing sleeve 44, of the projections 48*a* and 48*b* as much as possible and to prevent the developer peeled off the developing sleeve 44 from falling in the vicinity of the attracting magnetic pole S2. The former reason is carried out to cause the projections 48*a* and 48*b* to face the pair of end areas 440*a* and 440*b* even if the vertical positions of the projections 48*a* and 48*b* and the developing sleeve 44 shift more or less due to manufacturing error or the like in assembling the developing sleeve 44 with the developing container 41.

The latter reason is carried out because there is a possibility that the developer peeled off the developing sleeve 44 is attracted to the attracting magnetic pole S2 as it is if the developer falls in the vicinity of the attracting magnetic pole S2. Because the developer peeled off the developing sleeve 44 is in a condition in which the toner has been consumed by development and a toner amount is small, the developer adversely affects density of an image if the developer is attracted as it is by the developing sleeve 44 and is used again for development. Due to that, the lower end position of the projections 48*a* and 48*b* are set at most within the horizontal position that passes through the peak position of the attracting magnetic pole S2.

It is noted that while the surfaces of the projections 48*a* and 48*b* facing the developing sleeve 44 are flat surfaces approximately in parallel with the perpendicular direction in the case of the illustration, the surface may be an inclined surface inclined with respect to the perpendicular direction. In a case where the surfaces of the projections are formed into the flat surfaces, the surfaces can be readily caused to face the area including the peak position of the peeling magnetic pole S3 which is the position to be closed most between the developing container 41 and the developing sleeve 44 as described later even if the vertical positions of the projections 48*a* and 48*b* and the developing sleeve 44 shift more or less by manufacturing error or the like. In a case where the surface is formed as the inclined surface inclined such that the closer a lower part of the inclined surface, the further the inclined surface separates from the developing sleeve 44, the distance from the developing sleeve 44 can be increased at the position close to the attracting magnetic pole S2 while shortening the distance from the area including the peak position of the peeling magnetic pole S3. Thereby, the developer peeled off the developing sleeve 44 is hardly immediately attracted to the developing sleeve 44.

A part of the circumference of the developing sleeve 44 may be covered by forming the surface of the projections 48*a* and 48*b* facing the developing sleeve 44 as a curved surface or as a surface composed of a plurality of surfaces having different inclinations. In this case, the surface may include the peak position of the conveyance magnetic pole N2 upstream in the rotation direction of the developing sleeve 44 of the peeling magnetic pole S3. However, it is preferable to arrange such that the gap between the developing sleeve 44 and the upper wall 41*k* does not become too small. It is necessary to at least arrange such that the projection does not reach the opening portion 41*h* of the developing container 41.

Next, positions where the developing container 41 is brought closer to the developing sleeve 44, i.e., longitudinal positions and areas for forming the projections 48*a* and 48*b*, will be described. The internal pressure tends to be reduced from the areas where the amount of developer of the developer retained portion α in the vicinity of the peeling magnetic pole S3 is small at both longitudinal end portions of the developing sleeve 44 in the longitudinal direction of the developing sleeve 44 as described above. It is because the magnetic lines of force flow in the direction of the end portion and the direction in which the developer is peeled off flows in the end portion side by being attracted by the magnetic lines of force in the longitudinal end portions of the developing sleeve 44 as described above. Therefore, the area in which the developing container 41 is brought closer to the developing sleeve 44 is preferable to be the area corresponding to the area in which the fall direction of the developer peeled off in the peeling area flows to the end portion side.

Here, the area in which the fall direction of the developer peeled off the developing sleeve 44 flows to the end portion side means as follows. At first, an observation is made on behavior of the developer within a range in which the peeling area, i.e., the area in which the component in the rotational center direction of the developing sleeve 44 of the magnetic force is 0 N or less, is projected to a surface into which the developer peels off and falls. In a case where a directional component of moving velocity of the peeled developer is divided into a gravity direction and a longitudinal direction vertical thereto at this time, the area described above refers to an area where average velocity of the component in the direction of the longitudinal end, in a case where the peeled developer moves by 1 mm in the longitudinal direction, is 3% or more with respect to average velocity in the gravity direction. That is, the average velocity in a predetermined time, e.g., 5 to 10 seconds, during which the developer peeled off in the peeling area moves 1 mm in the longitudinal direction is divided into the gravity direction component and a longitudinal end direction component heading to the end direction of the developing sleeve 44 in relation to the longitudinal direction. In this case, the pair of end areas 440*a* and 440*b* is areas in which the longitudinal end direction component has the rate of 3% or more with respect to the gravity direction component.

Accordingly, as for the longitudinal direction, it is desirable to bring the developing container 41 closer to the developer retained portion α in the vicinity of the peeling magnetic pole S3 upstream in the rotation direction corresponding at least to the area. Still further, it is preferable to bring the area of 5 mm or more to the inside in the longitudinal direction from this range in order to exhibit enough effects including tolerance or the like. Due to that, according to the present embodiment, the pair of end areas 440*a* and 440*b* is areas having a length of 3% or more, e.g., 10 mm or more, of the length of the coating area from both ends of the coating area in terms of the longitudinal direction of the developing sleeve 44.

Meanwhile, in a case where a range in which the developing container 41 is brought closer to the developing sleeve 44 in the longitudinal direction is too long, an increase of the internal pressure within the developing apparatus becomes remarkable, and there is a possibility that the airflow flows out from the end portions even if the abovementioned countermeasure is taken. Therefore, the longitudinal range in which they are brought closer is set to be one-fifth or less of the whole longitudinal length of the coating area.

According to the present embodiment, the longitudinal lengths from the ends of the coating area of the pair of end areas 440*a* and 440*b* are preferable to be 10% or less, e.g., 40 mm or less, of the longitudinal length of the coating area, respectively. It is because the areas of the longitudinal end portions where the amount of developer of the developer retained portion α in the vicinity of the peeling magnetic pole S3 is small are the areas of 10% or less, e.g., 40 mm or less, of the length of the coating area even if they are long from both ends of the coating area as described above. Accordingly, as for the longitudinal direction, the projections 48*a* and 48*b* are set at the position and length facing the pair of end areas 440*a* and 440*b* having such lengths.

Still further, in order to enhance the pressure loss of the area in which the developing container 41 as described above is brought closer to the developing sleeve 44, the closer the distance G between the surface of the developing sleeve 44 and the projections 48*a* and 48*b* of the developing container 41 that are the parts facing the surface, the greater the effect is. Still further, a condition in which the pressure loss is maximized, i.e., the developer is in contact with the developer retained portion α in the vicinity of the peeling magnetic pole S3 and the developing container 41 so as to shut the path, is desirable. That is, it is preferable to form the developing container 41 such that the parts, i.e., the projections 48*a* and 48*b*, facing the pair of end areas 440*a* and 440*b* is in contact with the developer borne by the developing sleeve 44. More specifically, it is more preferable to arrange such that the part in which the developer of the developer retained portion α in the vicinity of the peeling magnetic pole S3 bristles most is in contact with the projections 48*a* and 48*b*.

Here, the condition in which the developer is in contact means a condition in which the developer is in contact with the projections 48*a* and 48*b* in a state in which the developing apparatus 4 is driven while being installed with the angle normally used and in a state in which the developing apparatus 4 is halted after a predetermined time in a same manner with a verification experiment described later. Meanwhile, in a case where the developer is in contact with the developing container 41, the developer accumulates if the distance between the surface of the developing sleeve 44 and the developing container 41 facing thereto is too close. Therefore, it is preferable to ease the regulation of the developer in the area more than the regulation of the layer thickness by the developing blade 42 and the regulating magnetic pole N1, i.e., the third magnetic pole.

The magnetic brush in regulating the layer thickness depends on strength of magnetic field. Here, the distance between the pair of end areas 440*a* and 440*b* and the projections 48*a* and 48*b* of the developing container 41 is represented as G1, the magnetic force of the peeling magnetic pole S3 as H1, a distance between the developing blade 42 and the developing sleeve 44 as G2 and a magnetic force of the regulating magnetic pole N1 as H2. In this case, it is preferable to satisfy G1×H1>G2×H2.

According to the present embodiment, the distance between the developing container 41 and the pair of end areas 440*a* and 440*b* is shortened more than the distance between the developing container 41 and the center area 441 in the vicinity of the peeling magnetic pole S3 of the coating area of the developing sleeve 44 as described above. This arrangement makes it possible to increase the pressure loss at the longitudinal end portions of the developing apparatus 4 in which the amount of the developer of the developer retained portion α in the vicinity of the peeling magnetic pole S3 is smaller than that of the center portion and to suppress scattering of the developer from the longitudinal end portions.

Verification Experiment

Next, verification experiments carried out to confirm the effects of the embodiment described above will be described. In the verification experiments, the developing apparatus 4 constructed in accordance with the first embodiment described above is used to measure an amount of toner scattering from the vicinity of the opening portion of the developing container 41 in driving the developing apparatus 4. Conditions of the developing apparatus 4 were as follows.

Firstly, as for the rotation direction of the developing sleeve 44, a magnetic field of 0.1 mm from the surface of the developing sleeve 44 was measured, and the component was divided in the tangential and normal directions of the developing sleeve 44. Then, the developing container 41 was brought closer to the projections 48*a* and 48*b* into an area by 6 mm upstream and by 4 mm downstream in the rotation direction of the developing sleeve 44 from the area upstream of the peeling area and where the tangential component is minimized, i.e., the normal component is maximized, in the vicinity of the peeling magnetic pole S3.

As for the longitudinal direction of the developing sleeve 44, the developing container 41 was removed, the developer peeled off the developing sleeve 44 was photographed and velocity component was derived by using PIV (particle image velocimetry). As a result, average velocity of the developer per 1 mm in the longitudinal direction at a part by about 4 mm from the both ends of the coating area had a rate in which the longitudinal end direction component is 3% or more with respect to the gravity direction component. Therefore, the developing container 41 was brought closer to the projections 48*a* and 48*b* to the area of 10 mm respectively from the both ends of the coating area.

The developing apparatus 4 used in the verification experiment had 300 μm of the distance G2 between the developing blade 42 and the surface of the developing sleeve 44, 65 mT of the magnetic force of the regulating magnetic pole N1 and 35 mT of the magnetic force H1 of the peeling magnetic pole S3. In order to satisfy the relationship of G1×H1>G2×H2, the distance G1 between the pair of end areas 440*a* and 440*b* and the projections 48*a* and 48*b* of the developing container 41 was set to be 1 mm.

Next, a method for measuring a toner scattering amount adopted in the verification experiment of this time will be briefly described. The scattering toner of the developing apparatus 4 scatters to the outside with the airflow passing through a drum facing area of the upper wall 41*k* and the photosensitive drum 1. Then, approximate center of the airflow was irradiated with a line laser so as to be vertical to the developing sleeve 44 and the photosensitive drum 1. The line laser is a laser beam irradiated in line having a certain line with and forming a fan-like two-dimensional plane optical path and is formed normally by scattering a dot laser in a certain direction by a cylindrical lens. The scattering toner flying on the optical path of the line laser scatters the laser light. Due to that, it is possible to measure a number and loci of the scattering toners existing in a range in which the laser is irradiated by observing by a high-speed camera or the like from a direction approximately vertical from the direction in which the line laser is irradiated.

As for the line laser, a YAG laser manufactured by Japan Laser Corporation was used as a light source, and the cylindrical lens was modified such that the line width to be irradiated becomes 0.5 mm. As for the observation, a high-speed camera SA-3 manufactured by Photron Co. was used, and set values such as a frame rate and an exposure time of the high-speed camera and an optical system such as lenses were selected to be able to observe the scattering toner on the line laser.

The number of scattering toners from the developing apparatus 4 was measured by the method described above, and the number was converted to a number of scattering toners corresponding to that per one A4-size sheet from the line width and the observation time.

As for the developing apparatus 4 in the verification experiment, a developing apparatus of image RUNNER ADVANCE C3530 manufactured by Canon Corp. was remodeled to the configuration of the first embodiment, and a configuration that includes no projections 48*a* and 48*b* of the first embodiment was set as a comparative example. The toner used was what silica and titanium oxide were added as external additives to that having 6.6 μm of center particle size based on polyester to modify fluidity and a charge amount. The carrier in which ferrite was coated by acrylic resin and having 35 μm of center particle size was used. The toner concentration was modified such that a toner weight becomes 10% of a total weight of the developer.

A cutting experimental tool capable holding and driving the developing apparatus 4 and the photosensitive drum 1 with a same positional relationship with a main body of the image RUNNER ADVANCE C3530 was manufactured, and the photosensitive drum 1 was driven with 264 mm/s of line speed. The verification experiment was carried out under the abovementioned conditions after outputting 100 sheets with 40% of image density under an environment of 23 degree of room temperature and 50% of humidity.

Figure 13:
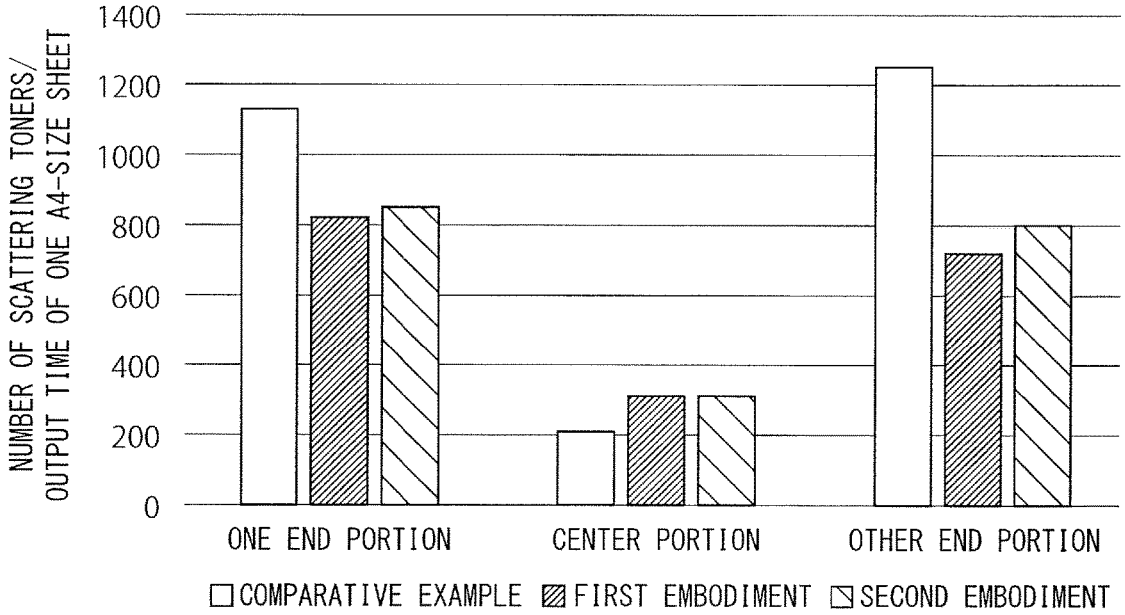
FIG. 13 is a graph indicating numbers of scattered toners at a longitudinal position of the developing sleeve of the first and second embodiments and of a comparative example.

FIG. 13 indicates the result of the verification experiments. A horizontal axis in FIG. 13 represents the longitudinal positions of the coating area of the developing sleeve 44 and a vertical axis represents a number of scattering toners corresponding to what per one A4 size sheet. As it is apparent from FIG. 13, the number of scattering toners was extremely large at both ends as compared to the longitudinal center portion in the comparative example. In the configuration of the first embodiment, the number of scattering toners at the longitudinal end portions (one end portion and other end portion) was reduced as compared to those of the comparative example and was increased slightly at the center portion. From what described above, it was found that scattering of the toner from both longitudinal end portions, which is the main factor of soiling, can be suppressed by the configuration of the first embodiment as compared to the configuration of the comparative example.

Second Embodiment

A second embodiment of the developing apparatus will be described with reference to FIGS. 14, 15A and 15B. The upper surface of the projections 48*a* and 48*b*, i.e., the bottom surface forming the space, forming the space 49 above the projections 48*a* and 48*b* has been formed approximately horizontally in the first embodiment described above. In contrast to that, the bottom surface is inclined in the present embodiment. Because structures and operations of the present embodiment other than that are the same with those of the first embodiment, the same components will be denoted by the same reference numerals and description and illustration of the same structures will be omitted or simplified here, and the following description will be made centering on parts different from those of the first embodiment.

The developing apparatus 4A of the present embodiment is also configured such that distances between a developing container 41A and a pair of end areas 440*a* and 440*b* are shortened more than a distance from a center area 441 in the vicinity of the peeling magnetic pole S3 of the coating area of the developing sleeve 44. Therefore, the developing container 41A has projections 48Aa and 48Ab projecting toward the developing sleeve 44 more than a part facing the center area 441 at parts facing the pair of end areas 440*a* and 440*b*. Then, a space 49A is defined above the projections 48Aa and 48Ab between the upper wall 41*k*.

The space 49A is capable of reducing an amount of the developer scattering out of the developing container 41A by the following reasons. That is, when air is discharged out of the developing container 41A, the air is discharged in a condition of not containing the developer so much because the air containing the developer circulates within the space 49A. Therefore, the amount of the developer scattering out of the developing container 41A can be reduced. However, there is a possibility that the space 49A accumulates the developer due to retention or the like of the developer. Then, if the developer accumulates on bottom surfaces 50*a* and 50*b*, i.e., upper surfaces of the projections 48Aa and 48Ab, forming the space 49A, the developer cannot be fully peeled off the developing sleeve when the accumulated developer collapses at once, emerging on an output image as a peeling failure. Then, the present embodiment is arranged such that the developer is hardly accumulated at this part while keeping the function of the configuration of the first embodiment.

Figure 14:
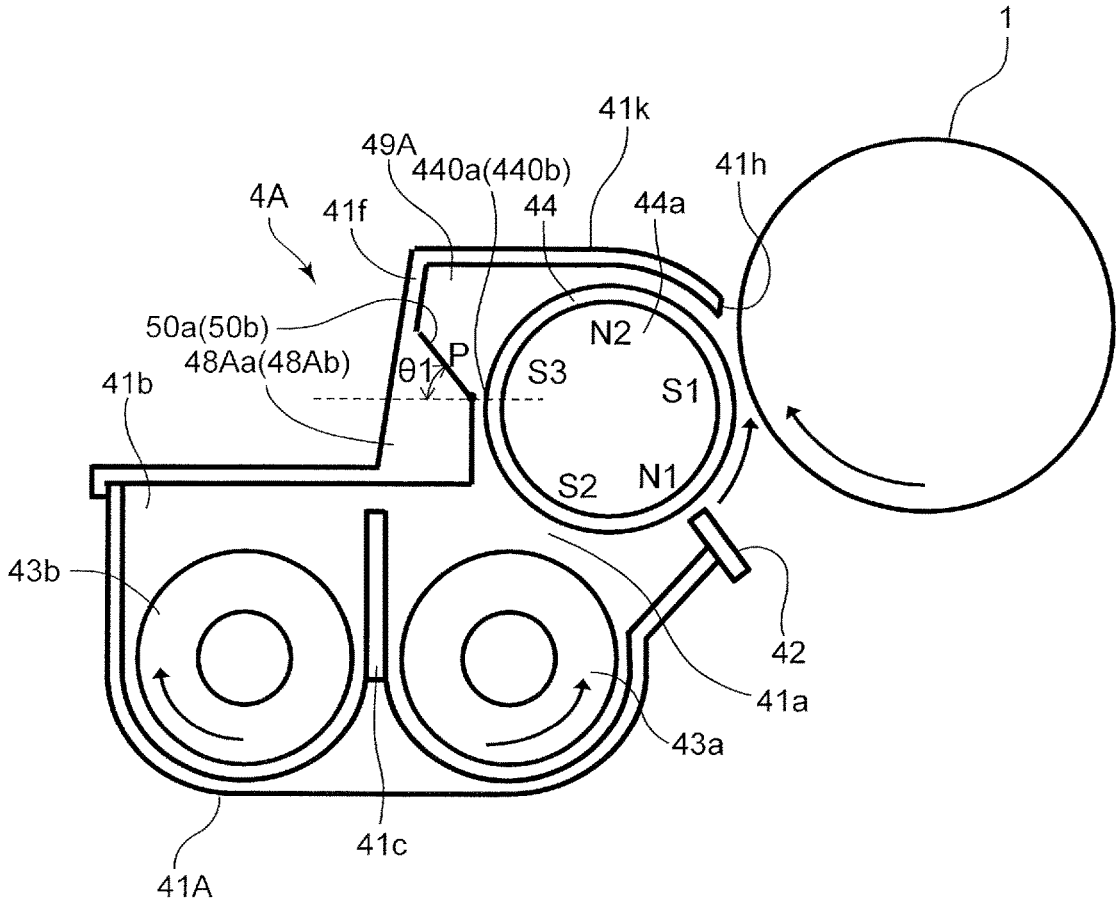
FIG. 14 is a schematic transverse section view of a configuration of a developing apparatus of a second embodiment.
Figure 15A:
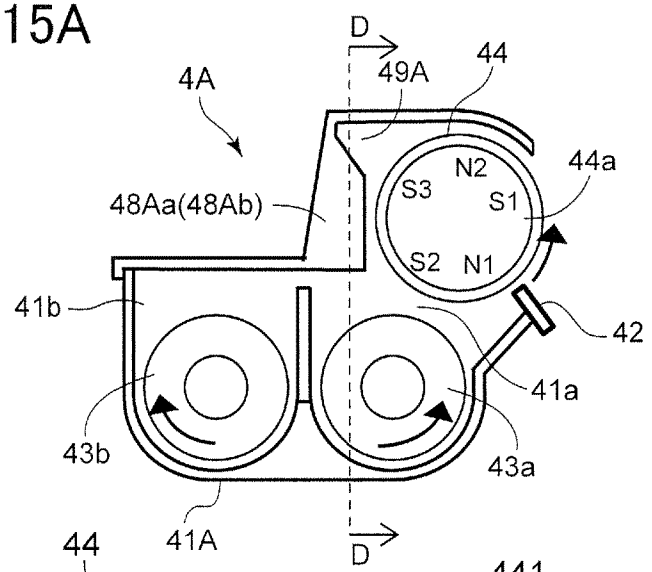
FIG. 15A is a schematic transverse section of the configuration of the developing apparatus of the second embodiment taken along a position different from that in FIG. 14.
Figure 15B:
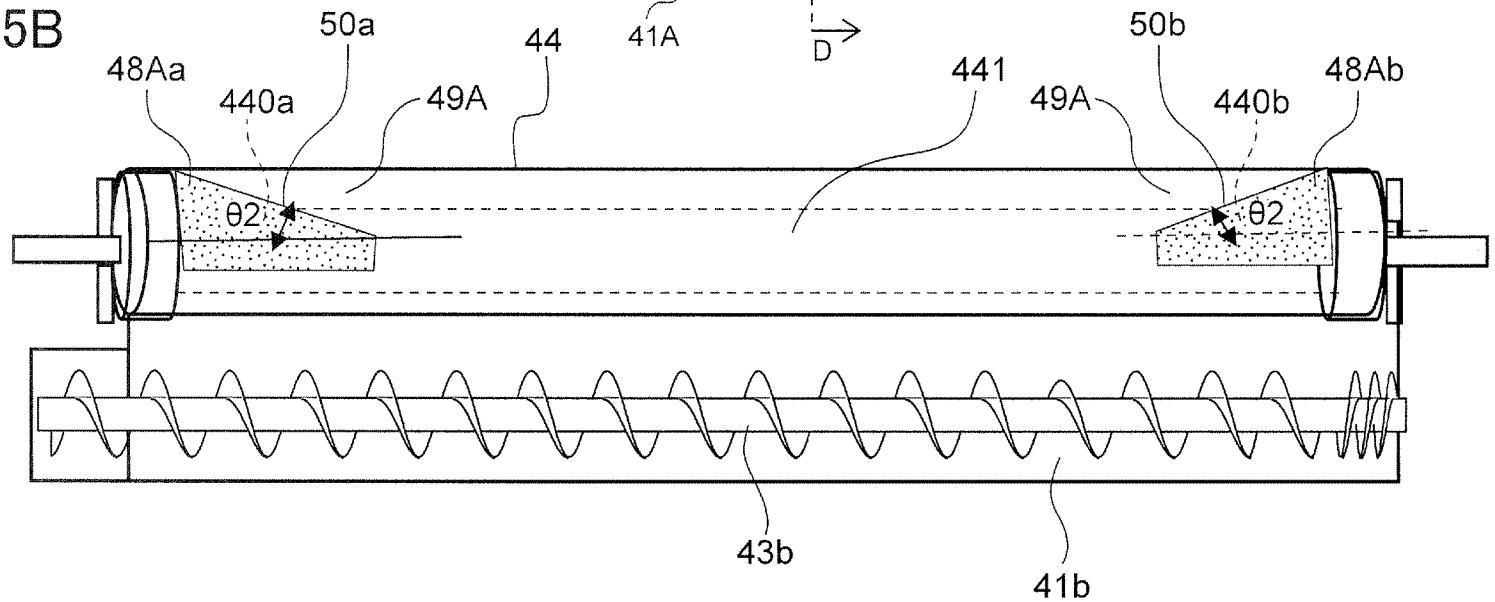
FIG. 15B is a longitudinal section view of the developing apparatus taken along a line D-D in FIG. 15A.

Specifically, as illustrated in FIG. 14, the bottom surfaces 50*a* and 50*b* forming the space 49A are inclined downward to the developing sleeve 44 with an angle θ1 with respect to the horizontal direction. Then, in a case where an angle of rest of the developer is represented by a, the bottom surfaces 50*a* and 50*b* are arranged such that $\theta 1>\alpha$ is satisfied to let the developer accumulated on the bottom surfaces 50*a* and 50*b* easily collapse and to let the developer hardly accumulate on the bottom surfaces 50*a* and 50*b*.

Meanwhile, there is a possibility that an amount of the toner scattering in the longitudinal end portions increases if the developer flows to the longitudinal both sides of the developing sleeve 44 when the developer accumulated on the bottom surfaces 50*a* and 50*b* collapses and flows down to both longitudinal sides of the developing sleeve 44. Therefore, as illustrated in FIG. 15B, the bottom surfaces 50*a* and 50*b* are inclined with an angle θ2 with respect to the horizontal direction downward to the center in relation to the longitudinal direction. This arrangement makes it possible to suppress the developer flowing down from the bottom surfaces 50*a* and 50*b* from flowing to the end portion sides because the developer flowing down from the bottom surfaces 50*a* and 50*b* flows to the center side in the longitudinal direction.

However, in a case where θ2 is too large, there is a possibility that the developer concentrates to the center side, causing a peeling failure of the developer from the developing sleeve 44. Therefore, the angle θ2 is set so as to satisfy $\theta 2<\alpha$. In short, the angle of the bottom surfaces 50*a* and 50*b* satisfies $0<\theta 2<\alpha$ and further satisfies $\theta 1>\alpha>\theta 2>0$.

According to the present embodiment, the bottom surfaces 50*a* and 50*b* defining the space 49A are inclined as described above even if the space 49A exists above the projections 48Aa and 48Ab. This arrangement makes is possible to suppress the developer from accumulating on the bottom surfaces 50*a* and 50*b* and to suppress an image failure from occurring due to a peeling failure.

It is noted a verification experiment was carried out in the same manner with the first embodiment described above also for the configuration of the present embodiment, i.e., the second embodiment. Conditions of the verification experiment are the same with those described above. An angle of rest after use of the developer of a combination of toner and carrier used in the verification experiment was about 40 degrees. Therefore, θ1 was set at 45 degrees and θ2 was set at 30 degrees in the configuration of the second embodiment used in the verification experiment.

FIG. 13 described above indicates results of the verification experiment. The configuration of the second embodiment also exhibited almost the same effects with the first embodiment. It could be seen from what is described above, the configuration of the second embodiment can suppress scattering of toner from the longitudinal end portions which is a main factor of soiling in the same manner with the configuration of the first embodiment as compared to a configuration of a comparative example.

Other Embodiments

While each embodiment described above has been described in a case where the printer is used as the image forming apparatus, the present disclosure is also applicable to an image forming apparatus such as a copier, a facsimile machine and a multi-function printer other than the printer.

Still further, the configuration of the developing apparatus in which the developer is supplied from the developer chamber to the developing sleeve and the developer peeled off the developing sleeve is collected by the developer chamber in each embodiment described above. However, the present disclosure is also applicable to a so-called function separated configuration in which the developer chamber supplies the developer to the developing sleeve and a collecting chamber collects the developer from the developing sleeve.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-242138, filed Dec. 18, 2017, which is hereby incorporated by reference herein in its entirety.

What is claimed is:

1. A developing apparatus comprising:

a developing container storing two-component developer containing nonmagnetic toner and magnetic carrier;

a rotatable developer bearing member configured to bear the developer;

a magnet provided in the developer bearing member and having a first magnetic pole and a second magnetic pole of the same polarity as the first magnetic pole, the second magnetic pole being adjacent to and downstream of the first magnetic pole in a rotation direction of the developer bearing member; and a wall portion disposed to face the developer bearing member in an area downstream of the first magnetic pole and upstream of the second magnetic pole in the rotation direction of the developer bearing member and configured such that gaps between the wall portion and respective end portions of a developer bearing area which bears the developer on the developer bearing member in a rotation axis direction of the developer bearing member are smaller than a gap between the wall portion and a center portion of the developer bearing area.

2. The developing apparatus according to claim 1, wherein a length of each end portion of the developer bearing area is 3% or more than a length of the developer bearing area.

3. The developing apparatus according to claim 2, wherein the length of each end portion of the developer bearing area is 10% or less than the length of the developer bearing area.

4. The developing apparatus according to claim 1, further comprising a screw configured to convey developer to be supplied to the developer bearing member, the screw being located below the developer bearing member in a perpendicular direction.

5. The developing apparatus according to claim 1, wherein an upper end of the wall portion facing each end portion of the developer bearing area is higher than a peak position, at which magnetic flux density of the first magnetic pole becomes a peak, on the developer bearing member in a perpendicular direction.

6. The developing apparatus according to claim 1, further comprising:

a first chamber configured to store developer to be supplied to the developer bearing member;

a second chamber configured such that the developer circulates between the first chamber and the second chamber; and a partition wall dividing the first and second chambers, wherein a center portion of the wall portion comprises the partition wall.

7. The developing apparatus according to claim 6, wherein an end wall portion, facing one of the end portions of the developer bearing area, of the wall portion is attached to the partition wall.

8. The developing apparatus according to claim 1, wherein an outer end of an end wall portion, facing one of the end portions of the developer bearing area, of the wall portion is located outside of an end of the developer bearing area on the same side as the outer end in the rotation axis direction.

9. The developing apparatus according to claim 1, wherein a lower end of the wall portion facing each end portion of the developer bearing area is higher than a peak position, at which magnetic flux density of the second magnetic pole becomes a peak, on the developer bearing member in a perpendicular direction.

* * * * *